US011454067B2

(12) United States Patent
Konduc et al.

(10) Patent No.: US 11,454,067 B2
(45) Date of Patent: Sep. 27, 2022

(54) DRILL FLOOR SUPPORT STRUCTURES

(71) Applicant: NOV CANADA ULC, Calgary (CA)

(72) Inventors: Kameron Wayne Konduc, Edmonton (CA); Randy Steven Stoik, Leduc County (CA); Jonathan Douglas Callaghan, Edmonton (CA)

(73) Assignee: NOV CANADA ULC, Calgary (CA)

( * ) Notice: Subject to any disclaimer, the term of this patent is extended or adjusted under 35 U.S.C. 154(b) by 0 days.

(21) Appl. No.: 17/250,576

(22) PCT Filed: Aug. 6, 2019

(86) PCT No.: PCT/CA2019/000114
§ 371 (c)(1),
(2) Date: Feb. 4, 2021

(87) PCT Pub. No.: WO2020/028969
PCT Pub. Date: Feb. 13, 2020

(65) Prior Publication Data

US 2021/0172260 A1 Jun. 10, 2021

Related U.S. Application Data

(60) Provisional application No. 62/715,054, filed on Aug. 6, 2018.

(51) Int. Cl.
*E21B 15/00* (2006.01)

(52) U.S. Cl.
CPC ..... *E21B 15/006* (2013.01)

(58) Field of Classification Search
CPC ..... E21B 15/003; E21B 7/02
See application file for complete search history.

(56) References Cited

U.S. PATENT DOCUMENTS

| | | | |
|---|---|---|---|
| 295,172 | A | 3/1884 | Hill |
| 1,557,070 | A | 10/1925 | Logue |
| 2,420,803 | A | 5/1947 | Tobin |

(Continued)

FOREIGN PATENT DOCUMENTS

| | | | |
|---|---|---|---|
| CA | 3016910 | A1 | 9/2017 |
| CN | 101476312 | A | 7/2009 |

(Continued)

OTHER PUBLICATIONS

"Ackerman steering geometry", Wikipedia, [Online] Retrieved from the Internet : <https://en.wikipedia.org/wiki/Ackermann_steering_geometry>, (Accessed Jan. 11, 2017), 3 pgs.

(Continued)

*Primary Examiner* — Shane Bomar
(74) *Attorney, Agent, or Firm* — Schwegman Lundberg & Woessner, P.A.

(57) ABSTRACT

The present disclosure relates to a modular drilling cellar configured to be arranged beneath a drill floor of a drilling rig. The cellar may have a housing for storing well head equipment and a drill floor support structure. The drill floor support structure may have a pair of support legs, each leg may have an extension portion, a column portion, and a bearing foot. Each of the extension portion and column portion may be configured to be arranged in a reading position and an operating position.

20 Claims, 20 Drawing Sheets

(56) References Cited

U.S. PATENT DOCUMENTS 2,657,017 A 10/1953 Curtis
2,663,375 A 12/1953 Caldwell
2,781,108 A 2/1957 Selberg et al.
3,063,509 A 11/1962 Guier
3,099,323 A 7/1963 Kelley
3,156,328 A * 11/1964 Bender ..... E21B 7/02 52/152
3,228,151 A 1/1966 Woolslayer et al.
3,271,915 A 9/1966 Woolslayer et al.
3,327,997 A 6/1967 Howard
3,333,377 A 8/1967 Woolslayer et al.
3,421,596 A 1/1969 Christensen
3,477,235 A 11/1969 Branham et al.
3,483,933 A 12/1969 Dyer et al.
3,502,166 A 3/1970 Christenson et al.
3,774,780 A 11/1973 Buffington
3,807,109 A 4/1974 Jenkins et al.
3,828,513 A 8/1974 Vanderklaauw
3,911,980 A 10/1975 Mccoll
3,922,825 A 12/1975 Eddy et al.
3,942,593 A 3/1976 Reeve, Jr. et al.
3,949,818 A 4/1976 Russell
3,977,542 A 8/1976 Stolzer
4,068,487 A 1/1978 Pease et al.
4,081,932 A 4/1978 Armstrong
4,128,229 A 12/1978 Elliston
4,135,340 A 1/1979 Cox et al.
4,269,395 A 5/1981 Newman et al.
4,290,495 A 9/1981 Elliston
4,324,077 A 4/1982 Woolslayer
4,336,840 A * 6/1982 Bailey ..... E21B 7/02 254/93 VA
4,366,650 A 1/1983 Patterson
4,375,241 A 3/1983 Gallon
4,375,892 A 3/1983 Jenkins et al.
4,387,814 A 6/1983 Beduhn et al.
4,421,447 A 12/1983 Gudgel et al.
4,587,778 A 5/1986 Woolslayer et al.
4,823,870 A 4/1989 Sorokan
4,831,795 A 5/1989 Sorokan
4,837,992 A 6/1989 Hashimoto
4,885,893 A 12/1989 Wasterval, Jr. et al.
5,216,867 A 6/1993 Wasterval, Jr. et al.
5,407,302 A 4/1995 Springett et al.
5,492,436 A 2/1996 Suksumake
5,954,453 A 9/1999 Thomas
5,997,217 A 12/1999 Verret
6,045,297 A 4/2000 Voorhees et al.
6,054,829 A 4/2000 Young et al.
6,141,870 A 11/2000 Mcdermott et al.
6,148,940 A 11/2000 Hokanson et al.
6,171,027 B1 1/2001 Blankestijin
6,234,527 B1 5/2001 Poulin et al.
6,286,615 B1 9/2001 Bitelli
6,412,576 B1 7/2002 Meiners
6,474,926 B2 * 11/2002 Weiss ..... B65D 88/30 414/919
6,634,436 B1 10/2003 Desai
6,729,804 B1 5/2004 Roodenburg et al.
6,994,171 B2 2/2006 Orr et al.
6,997,647 B2 2/2006 Bennett, Jr. et al.
7,182,163 B1 * 2/2007 Gipson ..... B60S 9/20 180/8.5
7,308,953 B2 12/2007 Barnes
7,360,589 B2 4/2008 Moncus et al.
7,410,326 B2 8/2008 Morrison et al.
7,584,809 B1 9/2009 Flud
7,624,831 B2 12/2009 Orr et al.
7,765,749 B2 8/2010 Palidis
7,931,076 B2 4/2011 Ditta et al.
7,950,478 B2 5/2011 Terry
8,047,303 B2 11/2011 Donnally et al.
8,287,212 B2 10/2012 Roper
8,468,753 B2 6/2013 Donnally et al.
8,516,751 B2 8/2013 Konduc et al.
8,549,815 B2 10/2013 Donnally et al.
8,555,564 B2 10/2013 Wasterval
8,556,003 B2 10/2013 Souchek
8,875,911 B2 11/2014 Donnally et al.
9,091,125 B2 7/2015 Konduc et al.
9,091,126 B2 7/2015 Thiessen et al.
9,109,399 B2 8/2015 Murr et al.
9,212,778 B2 12/2015 Winter
9,463,833 B2 10/2016 Smith et al.
9,488,014 B2 * 11/2016 Sparkman ..... E21B 15/00
9,797,196 B2 10/2017 Taggart et al.
RE46,723 E 2/2018 Smith et al.
9,926,719 B2 3/2018 Reddy et al.
10,293,854 B2 5/2019 Nguyen et al.
10,471,986 B2 11/2019 Nguyen et al.
10,822,924 B2 11/2020 Konduc et al.
11,021,186 B2 6/2021 Nguyen et al.
2002/0185319 A1 12/2002 Smith
2003/0102166 A1 6/2003 Jortveit
2003/0147726 A1 8/2003 Tolmon et al.
2003/0172599 A1 9/2003 Frink
2004/0151549 A1 8/2004 Roodenburg et al.
2004/0211572 A1 10/2004 Orr et al.
2004/0211598 A1 10/2004 Palidis
2004/0240973 A1 12/2004 Andrews et al.
2006/0180564 A1 8/2006 Keppel
2007/0272762 A1 11/2007 Click et al.
2008/0257607 A1 10/2008 Winter
2009/0000218 A1 1/2009 Lee et al.
2009/0188677 A1 7/2009 Ditta et al.
2009/0283324 A1 * 11/2009 Konduc ..... A61P 9/00 175/57
2009/0321135 A1 12/2009 Vora et al.
2010/0150660 A1 6/2010 Nadarajah et al.
2010/0260555 A1 10/2010 Foo et al.
2010/0303586 A1 12/2010 Hankins et al.
2011/0072737 A1 3/2011 Wasterval
2011/0079568 A1 4/2011 Mau et al.
2011/0114386 A1 5/2011 Souchek
2011/0280104 A1 11/2011 Mcclung, III
2012/0047820 A1 3/2012 Donnally et al.
2012/0138327 A1 6/2012 Sorokan et al.
2012/0201632 A1 8/2012 Yater et al.
2012/0304553 A1 12/2012 Konduc et al.
2013/0168516 A1 7/2013 Winter
2013/0180186 A1 7/2013 Konduc et al.
2013/0269268 A1 * 10/2013 Thiessen ..... E21B 7/023 175/57
2013/0305632 A1 11/2013 Rivera, Sr. et al.
2013/0340572 A1 12/2013 Flusche
2013/0340998 A1 12/2013 Flusche
2013/0341036 A1 12/2013 Flusche
2014/0041855 A1 2/2014 Rodgers
2014/0090333 A1 4/2014 Vogt
2014/0158342 A1 * 6/2014 Smith ..... B62D 57/02 166/85.1
2014/0259985 A1 9/2014 Petrello et al.
2014/0262518 A1 9/2014 Reddy et al.
2014/0262519 A1 9/2014 Petrello et al.
2014/0262520 A1 9/2014 Petrello et al.
2014/0263685 A1 9/2014 Yustus et al.
2014/0270974 A1 9/2014 Seng et al.
2014/0270975 A1 9/2014 Seng et al.
2014/0331570 A1 11/2014 Fullerton et al.
2015/0014952 A1 1/2015 Morikawa
2015/0090450 A1 * 4/2015 Thiessen ..... E21B 33/14 166/85.4
2015/0122558 A1 5/2015 Van Raden
2015/0152690 A1 6/2015 Sorokan et al.
2015/0184466 A1 7/2015 Rivera, Sr. et al.
2015/0218891 A1 8/2015 Padira et al.
2015/0300038 A1 * 10/2015 Thiessen ..... E21B 7/023 52/745.18
2016/0052441 A1 2/2016 Korach
2016/0090788 A1 3/2016 Niemczyk
2016/0369523 A1 12/2016 Konduc et al.
2017/0081924 A1 * 3/2017 Smith ..... B62D 57/02
2017/0241126 A1 8/2017 Konduc et al.
2017/0254181 A1 9/2017 Konduc et al.

(56) References Cited

U.S. PATENT DOCUMENTS

| | | | | |
|---|---|---|---|---|
| 2018/0093705 | A1 | 4/2018 | Nguyen et al. | |
| 2018/0093706 | A1 | 4/2018 | Nguyen et al. | |
| 2019/0233006 | A1 | 8/2019 | Nguyen et al. | |
| 2021/0025263 | A1 | 1/2021 | Konduc et al. | |
| 2021/0062595 | A1 | 3/2021 | Rochon et al. | |
| 2022/0065048 | A1* | 3/2022 | Reddy | E21B 7/023 |

FOREIGN PATENT DOCUMENTS

| | | | |
|---|---|---|---|
| CN | 102536267 | A | 7/2012 |
| RU | 81516 | U1 | 3/2009 |
| RU | 96904 | U1 | 8/2010 |
| RU | 137053 | U1 | 1/2014 |
| SU | 1461858 | A1 | 2/1989 |
| SU | 1686052 | A1 | 10/1991 |
| SU | 1770509 | A1 | 10/1992 |
| WO | WO-2004094762 | A2 | 11/2004 |
| WO | WO-2008114064 | A1 | 9/2008 |
| WO | WO-2009002189 | A1 | 12/2008 |
| WO | WO-2010132174 | A1 | 11/2010 |
| WO | WO-2017155950 | A1 | 9/2017 |
| WO | WO-2018064746 | A1 | 4/2018 |
| WO | WO-2020028969 | A1 | 2/2020 |

OTHER PUBLICATIONS

"U.S. Appl. No. 15/285,946, Non Final Office Action dated Dec. 11, 2018", 8 pgs.
"U.S. Appl. No. 15/285,946, Notice of Allowance dated Jul. 9, 2019", 5 pgs.
"U.S. Appl. No. 15/285,946, Response filed Sep. 5, 2018 to Restriction Requirement dated Jul. 5, 2018", 6 pgs.
"U.S. Appl. No. 15/285,946, Response filed Mar. 11, 2019 to Non-Final Office Action dated Dec. 11, 2018", 8 pgs.
"U.S. Appl. No. 15/285,946, Restriction Requirement dated Jul. 5, 2018", 6 pgs.
"U.S. Appl. No. 15/349,661, Notice of Allowance dated Jan. 3, 2019", 8 pgs.
"U.S. Appl. No. 15/349,661, Response filed Oct. 26, 2018 to Restriction Requirement dated Aug. 28, 2018", 6 pgs.
"U.S. Appl. No. 15/349,661, Restriction Requirement dated Aug. 28, 2018", 5 pgs.
"U.S. Appl. No. 15/451,968, Non Final Office Action dated Sep. 10, 2018", 8 pgs.
"U.S. Appl. No. 15/451,968, Notice of Allowance dated Aug. 11, 2020", 7 pgs.
"U.S. Appl. No. 15/451,968, Preliminary Amendment filed Sep. 5, 2018", 5 pgs.
"U.S. Appl. No. 15/451,968, Response filed May 6, 2020 to Restriction Requirement dated Mar. 6, 2020", 5 pgs.
"U.S. Appl. No. 15/451,968, Response filed Nov. 18, 2019 to Restriction Requirement dated Sep. 18, 2019", 6 pgs.
"U.S. Appl. No. 15/451,968, Response filed Dec. 10, 2018 to Non Final Office Action dated Sep. 10, 2018", 10 pgs.
"U.S. Appl. No. 15/451,968, Response filed Jun. 5, 2019 to Restriction Requirement dated Apr. 5, 2019", 7 pgs.
"U.S. Appl. No. 15/451,968, Restriction Requirement dated Mar. 6, 2020", 6 pgs.
"U.S. Appl. No. 15/451,968, Restriction Requirement dated Apr. 5, 2019", 6 pgs.
"U.S. Appl. No. 15/451,968, Restriction Requirement dated Sep. 18, 2019", 6 pgs.
"U.S. Appl. No. 15/451,968, Supplemental Notice of Allowability dated Sep. 30, 2020", 4 pgs.
"U.S. Appl. No. 16/382,961, Final Office Action dated Nov. 12, 20", 8 pgs.
"U.S. Appl. No. 16/382,961, Non Final Office Action dated May 14, 2020", 7 pgs.
"U.S. Appl. No. 16/382,961, Notice of Allowance dated Jan. 28, 2021", 5 pgs.
"U.S. Appl. No. 16/382,961, Response filed Jan. 13, 2021 to Final Office Action dated Nov. 12, 2020", 6 pgs.
"U.S. Appl. No. 16/382,961, Response filed Aug. 10, 2020 to Non Final Office Action dated May 14, 2020", 7 pgs.
"Axles & Suspension Wheeled Moving System", Columbia Industries, [Online] Retrieved from the Internet : <http://www.joomag.com/magazine/columbiaindustries/0320299001391629028>, (Accessed Jan. 11, 2017), 4 pgs.
"Axles and Suspension", Columbia Industries, [Online] Retrieved from the Internet : <http://www.columbiacorp.com/axlesandsuspension.php>, (Mar. 17, 2016), 2 pgs.
"*Blue Calypso, LLC* v. *Groupon, Inc.*", CAFC, (Mar. 1, 2016), 46 pgs.
"Canadian Application Serial No. 3,016,910, Voluntary Amendment filed Jul. 8, 2019", 13 pgs.
"Entro Heavy Haul", Entro Industries, [Online] Retrieved from the Internet : <https://entro-eng.com/products/heavy-haul/heavy-haul-overview/>, (Accessed Jan. 11, 2017), 2 pgs.
"Entro Industries Homepage", [Online] Retrieved from the Internet : <https://entroeng.com/>, (Accessed Jan. 18, 2017), 2 pgs.
"European Application Serial No. 12791970.2, Extended European Search Report dated Sep. 2, 2015", 8 pgs.
"European Application Serial No. 12791970.2, Response filed Mar. 9, 2016 to Extended European Search Report dated Sep. 2, 2015", 32 pgs.
"In re Wolfensperger", 302 F.2d 950 (CCPA 1962), (May 18, 1962), 8 pgs.
"International Application Serial No. PCT/CA2012/000510, Response filed Mar. 14, 2013 to Written Opinion dated Aug. 24, 2012", 4 pgs.
"International Application Serial No. PCT/CA2012/000510, Written Opinion dated Aug. 24, 2012", 3 pgs.
"International Application Serial No. PCT/CA2015/000432, International Search Report dated Sep. 24, 2015", 3 pgs.
"International Application Serial No. PCT/CA2015/000432, Written Opinion dated Sep. 24, 2015", 5 pgs.
"International Application Serial No. PCT/CA2016/000229, International Search Report dated Oct. 26, 2016", 3 pgs.
"International Application Serial No. PCT/CA2016/000229, Written Opinion dated Oct. 26, 2016", 5 pgs.
"International Application Serial No. PCT/CA2017/000215, International Preliminary Report on Patentability dated Jan. 21, 2019", 5 pgs.
"International Application Serial No. PCT/CA2017/000215, International Search Report dated Jan. 9, 2018", 4 pgs.
"International Application Serial No. PCT/CA2017/000215, Written Opinion dated Jan. 9, 2018", 6 pgs.
"International Application Serial No. PCT/CA2019/000114, Article 3 4 Amendments filed Jun. 1, 2020", 8 pgs.
"International Application Serial No. PCT/CA2019/000114, International Search Report dated Nov. 20, 2019", 3 pgs.
"International Application Serial No. PCT/CA2019/000114, Written Opinion dated Nov. 20, 2019", 5 pgs.
"International Application Serial No. PCT/US2014/037431, International Search Report dated Oct. 7, 2014", 2 pgs.
"International Application Serial No. PCT/US2014/037431, Written Opinion dated Oct. 7, 2014", 6 pgs.
"International Application Serial No. PCT/US2016/019507, International Search Report dated Dec. 21, 2016", 6 pgs.
"International Application Serial No. PCT/US2016/019507, Written Opinion dated Dec. 21, 2016", 9 pgs.
"International Application Serial No. PCT/US2017/021095, International Preliminary Report on Patentability dated Sep. 20, 2018", 11 pgs.
"International Application Serial No. PCT/US2017/021095, International Search Report dated Jun. 12, 2017", 5 pgs.
"International Application Serial No. PCT/US2017/021095, Written Opinion dated Jun. 12, 2017", 9 pgs.
"Nabors Oil Rig Move", YouTube, [Online] Retrieved from the Internet : <https://www.youtube.com/watch?v=T4ELOeh6R6M>, (Oct. 22, 2008), 2 pgs.
"National Oilwell Varco Elevator/Substructure/Setback Cross-Section drawing", (Jul. 24, 1979), 1 pg.

(56) References Cited

OTHER PUBLICATIONS

"National Oilweil Varco Mast & Substructure Erection Sequence drawing", (Sep. 15, 1979), 1 pg.
"Photograph of Uralmesh rig", (Jul. 2014), 1 pg.
"Photographs of typical Uralmesh train rig", (Sep. 2012), 2 pgs.
"Pin-on Walkers for Ideal® Rigs", Entro Industries, [Online] Retrieved from the Internet : <https://entro-eng.com/products/walking-systems/ideal-pin-on-walkers/>, (Accessed Jan. 11, 2017), 2 pgs.
"Steering", Wikipedia, [Online] Retrieved from the Internet : <https://en.wikipedia.org/wiki/Steering>, (Accessed Jan. 11, 2017), 12 pgs.
"U.S. Appl. No. 16/948,994, Restriction Requirement dated Dec. 24, 2021", 6 pgs.
"U.S. Appl. No. 16/948,994, Response filed Feb. 24, 2022 to Restriction Requirement dated Dec. 24, 2021", 6 pgs.
"U.S. Appl. No. 16/557,644, Restriction Requirement dated Mar. 1, 2022", 5 pgs.
"U.S. Appl. No. 16/948,994, Non Final Office Action dated Mar. 24, 2022", 10 pgs.
"U.S. Appl. No. 16/557,644, Response filed May 2, 2022 to Restriction Requirement dated Mar. 1, 2022", 7 pgs.

* cited by examiner

DRILL FLOOR SUPPORT STRUCTURES

CROSS-REFERENCE TO RELATED APPLICATIONS

This application is a U.S. National Stage Filing under 35 U.S.C. 371 from International Application No. PCT/CA2019/000114, filed Aug. 6, 2019, which claims priority to U.S. Provisional Application No. 62/715,054, entitled Drill Floor Support Structures, and filed Aug. 6, 2018, the content of each by which are hereby incorporated by reference herein in their entirety.

FIELD OF THE INVENTION

The present application is generally directed to drilling rigs. Particularly, the present disclosure relates to drilling rigs having cantilevered drill floors. More particularly, the present disclosure relates to support structures for cantilevered drill floors.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Rigs drilling in the high Arctic may include sealed units to retain heat during drilling operations and rig moves. These rigs may move as a convoy of trailers towed by trucks and self-propelled units as they move between drilling pads in the high Arctic. The typical rig move between pads may be several hundred yards or several miles. The complete rig may also move from well to well on the pad during drilling operations. During rig moves, the loads may be maintained below the tire capacity, bridge capacity, ice road capacity, or other limiting factors. Arctic wells may be drilled to depths of up to or exceeding 35,000 feet in some cases.

Drilling to great depths may require relatively large drilling rigs and relatively heavy equipment. For example, a relatively large wellhead Christmas tree and blowout preventer may be needed. These devices can add hundreds of thousands of pounds to the drill rig, and their height may require a relatively tall drill floor to allow for clearance of the Christmas tree and blowout preventer.

One style of rig for Arctic drilling is a cantilevered style. In a cantilevered style rig, the drill floor, mast, and well center may be cantilevered out over the well and wellhead to provide suitable vertical clearance for drilling operations. The cantilevered nature of the rig may enable the rig to traverse along a row of wells, completing each well as it moves parallel to the row of wells. However, as the drilling hookload on these cantilevered rigs increases during drilling operations, the drill floor may deflect downward as a result of the cantilevered design.

Additionally, there may be limited space surrounding a well, thus restricting the ability to place a support structure beneath a cantilevered drill floor. For example, production piping may extend from the well and run vertically and/or horizontally in varying configurations surrounding the well. Production piping may additionally be asymmetrical at a well, and/or piping for multiple wells on a multi-well drilling pad may differ among wells. Other structures or substructures may additionally or alternatively limit space beneath a drill floor. Additionally, spacing between adjacent wells or adjacent rows of wells on a pad drilling site may be relatively limited. There may also be ground pressure limitations or requirements surrounding wells. For example, spacing constraints may limit the size of a drill pad, and/or may limit the ability to prepare the ground to, or above, a particular ground pressure.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a modular drilling cellar configured to be arranged beneath a drill floor of a drilling rig. The cellar may include a housing for storing well head equipment and a drill floor support structure having a pair of support legs. Each support legs may have an extension portion coupled to the cellar and configured to be arranged in an operating position and a roading position. Each leg may additionally have a column portion coupled to the extension portion and configured to be arranged in an operating position and a roading position. Each leg may have a bearing foot coupled to the column portion. In some embodiments, each extension portion may include an extension member extendable from an outer sheath. Additionally or alternatively, the extension portion may include a pivoting frame. Additionally or alternatively, the extension portion may include a retractable frame. Each column portion may include two members coupled together at a hinged connection. Additionally or alternatively, each column portion may include a column member configured to scope through a collar coupled to the extension portion. Each bearing foot may be configurable and may have at least one removable section. In other embodiments, each bearing foot may have at least one hinged section. Each bearing foot may be coupled to the column portion via a load cell pin. Further, in some embodiments, each leg may be independently actuable. The modular drilling cellar may have a second pair of legs in some embodiments.

The present disclosure, in one or more embodiments, additionally relates to a drill floor support structure having a pair of legs, each leg configured to be arranged in a roading position and an operating position. Each leg may have an extension portion and a column portion, each of which is configured to be arranged in an operating position and a roading position. Moreover, each leg may have a bearing foot coupled to the column portion. In some embodiments, each extension portion may have: an extension member extendable from an outer sheath, a pivoting frame, and/or a retractable frame. In some embodiments, the column portion may include two members coupled together at a hinged connection. The column portion may include a column member configured to scope through a collar coupled to the extension portion. In some embodiments, each bearing foot may be configurable and may have at least one removable section. In other embodiments, each bearing foot may have at least one hinged section. Moreover, each leg of the drill floor support structure may be independently actuable in some embodiments.

The present disclosure, in one or more embodiments, additionally relates to a drilling rig having a drill floor and a drill floor support structure configured to transfer loading on the drill floor to a ground or pad surface. The drill floor support structure may have a pair of legs each configured to be arranged in a roading position and an operating position. Each leg may have an extension portion and a column portion, each of which may be configured to be arranged in an operating position and a roading position. Moreover, each leg may have a bearing foot coupled to the column portion. In some embodiments, each extension portion may have an extension member extendable from an outer sheath. Additionally or alternatively, each extension portion may have a pivoting frame and/or a retractable frame.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1A:
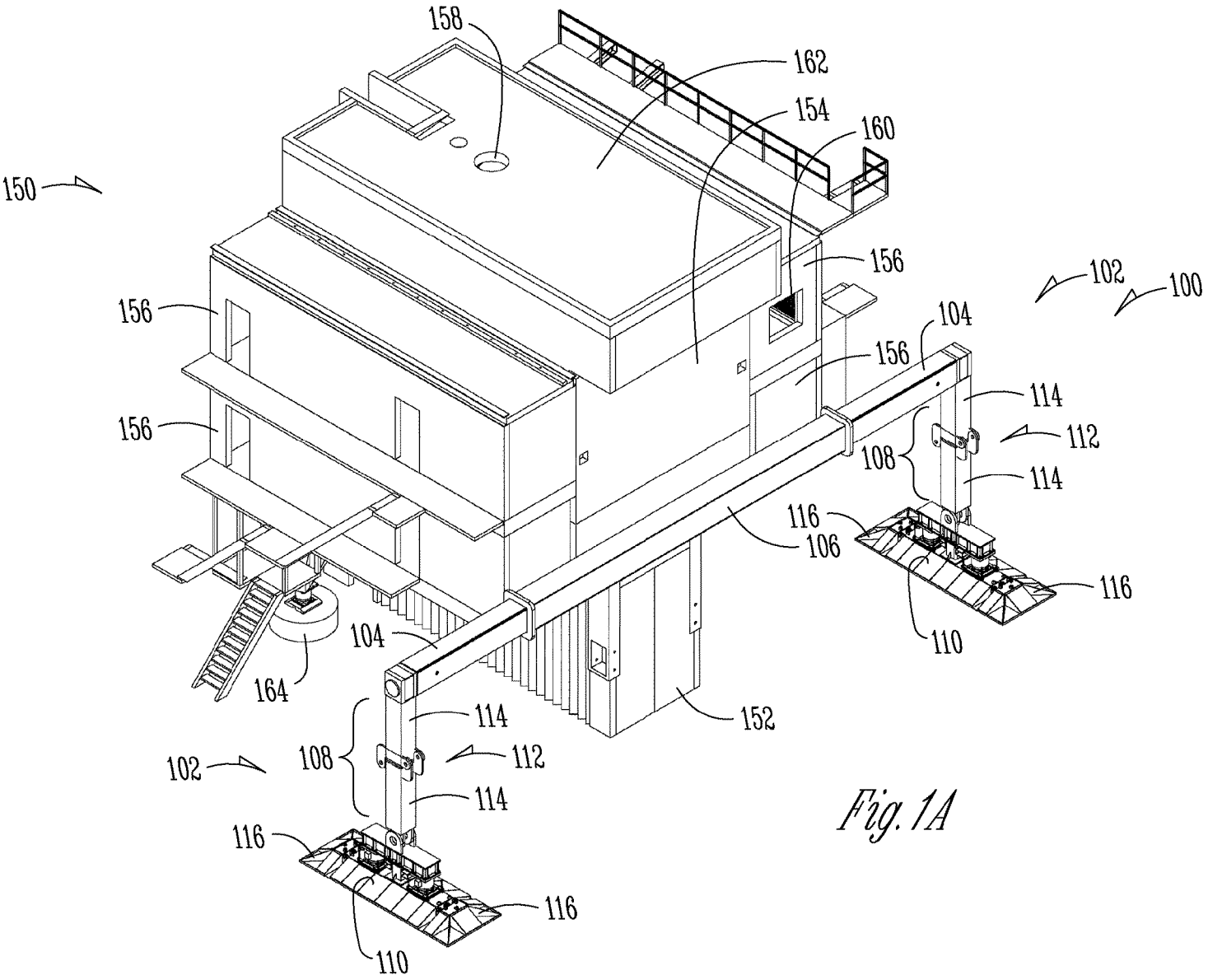
FIG. 1A is a perspective view of a drill floor support structure and a modular cellar of the present disclosure, with the extension portions and column portions of the drill floor support structure extended, according to one or more embodiments.

The present disclosure, in one or more embodiments, relates to a drill floor support structure configured to be arranged beneath a drill floor, such as a cantilevered drill floor, for supporting the drill floor during drilling operations. In particular, the drill floor support structure may have columns, legs, or outriggers configured to extend between the drill floor and a ground or pad surface to provide stiffening support to the drill floor. The drill floor support structure may be configured to transfer loading, including a dead load, hook load, wind load, and/or other loading, from the drilling floor to a ground surface or pad surface. In this way, the drill floor support structure may help reduce deflection of the drill floor caused by weight of equipment, operational loading, and/or other loading.

In some embodiments, a drill floor support structure of the present disclosure may couple to, or extend from, a drill floor, such as a lower surface or an edge of a drill floor. However, in other embodiments, a drill floor support structure may couple to, or extend from, a cellar module arranged generally beneath a drill floor. In other embodiments, a drill floor support structure may couple to, or extend from, another structure or substructure of a drilling rig or surrounding a well head. In still other embodiments, a drill floor support structure of the present disclosure may be a free-standing or independent structure arranged beneath a drill floor. In such embodiments, the drill floor support structure may be configured to couple to and/or abut an underside of the drill floor, for example.

Drill floor support structures of the present disclosure may generally be configured to accommodate limited spacing and reduced clearances around or above a well head. For example, a drill floor support structure of the present disclosure may be configured with a mechanism, or combination of mechanisms, to allow columns, legs, or outriggers to deploy without interfering with production piping or other structures, or to otherwise deploy within space constraints beneath a drill floor. In some embodiments, columns, legs, or outriggers of a drill floor support structure may be configured to transition between a roading position and one or more operating positions. In a roading position, the columns, legs, or outriggers may be generally retracted, withdrawn, or pivoted off of a ground or pad surface to clear cellar well houses as the drilling structure is removed from, or arranged in, the well area. In an operating position, the columns, legs, or outriggers may be extended laterally outward so as to extend generally between the drill floor and a ground or pad surface to provide stiffening support to the drill floor. Columns, legs, or outriggers may have more than one operating position, such that they may be arranged in different configurations as needed to accommodate differing geometries or spacing constraints. Moreover, columns, legs, or outriggers of the present disclosure may be configured to be independently actuable or drivable so as to accommodate asymmetrical geometries or spacing constraints around a well head.

In some embodiments, a drill floor support structure of the present disclosure may have columns, legs, or outriggers with one or more pivoting or rotating mechanisms. For example, columns, legs, or outriggers may be configured to pivot between one or more operating positions and a roading position. The columns, legs, or outriggers may additionally or alternatively be configured to pivot or rotate to other positions and/or to any suitable degree of rotation. In some embodiments, columns, legs, or outriggers may be configured to pivot or rotate about more than one axis and/or at more than one location. As another example, columns, legs, or outriggers may have one a plurality of members and hinges forming a retractable or collapsible frame. Pivoting, or rotating mechanisms may help to keep columns, legs, or outriggers clear of production piping and/or other structures while the drill floor support structure is moved into position over or around a well head. Additionally, swinging, pivoting, or rotating mechanisms may increase versatility of a drill floor support structure by allowing columns, legs, or outriggers, or portions thereof, to be pivoted, rotated, or swung to any suitable position or angle as needed to accommodate differing geometries and/or spacing constraints around different well heads.

Additionally or alternatively, a drill floor support structure of the present disclosure may have columns, legs, or outriggers with one or more foldable or jointed members. For example, columns, legs, or outriggers may have one or more joints or may otherwise be configured to separate into two or more foldable sections. Such folding members may allow the drill floor support structure, or portions thereof, to be retracted or pulled clear of production piping and/or other structures while the drill floor support structure is moved into position over or around a well head.

Additionally or alternatively, a drill floor support structure of the present disclosure may have one or more telescoping or scoping mechanisms. For example, columns, legs, or outriggers, or portions thereof, may be configured to retract into or pass through an outer sheath or collar. In some embodiments, columns, legs, or outriggers, or portions thereof, may have two or more telescoping sections configured to nestably engage one another. Such telescoping or scoping mechanisms may help to keep columns, legs, or outriggers clear of production piping and/or other structures while the drill floor support structure is moved into position over or around a well head. Additionally, telescoping or scoping mechanisms may increase versatility of a drill floor support structure. For example, in some embodiments, columns, legs, or outriggers, or portions thereof, may be extended or telescoped to a desired length up to the full extendable length of the component. In this way, columns, legs, or outriggers, or portions thereof, may be extended or telescoped to different lengths to accommodate differing geometries and/or spacing constraints around different well heads.

In general, drill floor support structures of the present disclosure may have bearing feet configured to transfer loading from the drill floor to a ground or pad surface generally beneath the drill floor. Bearing feet may be sized and shaped with different footprints to provide particular ground pressures and/or to accommodating spacing constraints or production piping geometries around well heads. In some embodiments, bearing feet may be configured with a rectangular, square, round, or cross or x-shaped footprint. In other embodiments, bearing feet may be configured with any other suitably shaped footprint. In some embodiments, bearing feet of the present disclosure may be configurable or reconfigurable. For example, a bearing foot may have one or more removable portions that may be detached and/or moved to modify the shape of the foot. In some embodiments, the foot may be configured such that the detachable portion(s) may be coupled to the foot at different locations. For example, a portion of a bearing foot may be operably attachable along a first side and along a second side of a bearing foot, depending on the needs of a particular well head and drill floor setup. Such configurable bearing feet may be modified as needed depending on differing geometries and/or spacing constraints around different well heads. In some embodiments, bearing feet may additionally or alternatively have pivotable or otherwise movable portions. The movable portions may allow the bearing feet to be maneuvered into or through relatively tight spaces. Additionally, in some embodiments, the movable portions may be used to modify the footprint of the bearing foot for operation.

Hydraulic cylinders, electric motors, and/or other driving or actuating mechanisms may be used to drive the various mechanisms described herein for deploying a drill floor support structure to an operating position or for retracting a drill floor support structure to a roading position. In some embodiments, columns, legs, or outriggers of the present disclosure may be independently drivable or actuable. In this way, columns, legs, or outriggers of a drill floor support structure may be deployed asymmetrically to accommodate asymmetrical geometries or spacing constraints around different well heads, for example. For example, a first leg of a drill floor support structure may be telescoped to a first length while a second leg of the support structure may be telescoped to a second length, which may be shorter or longer than the first length. In some embodiments, bearing feet of a drill floor support structure may be configured differently, using detachable or pivotable portions for example, to accommodate asymmetrical geometries or spacing constraints.

It is to be appreciated that a drill floor support structure of the present disclosure may incorporate any one of, any combination of, or all of, the above-described mechanisms. Some particular embodiments are described below with reference to FIGS. 1A-4C. However, it is to be appreciated that drill floor support structures of the present disclosure are not limited to the particular embodiments described below. Drill floor support structures incorporating any combination of the different mechanisms described herein are envisioned.

Figure 1B:
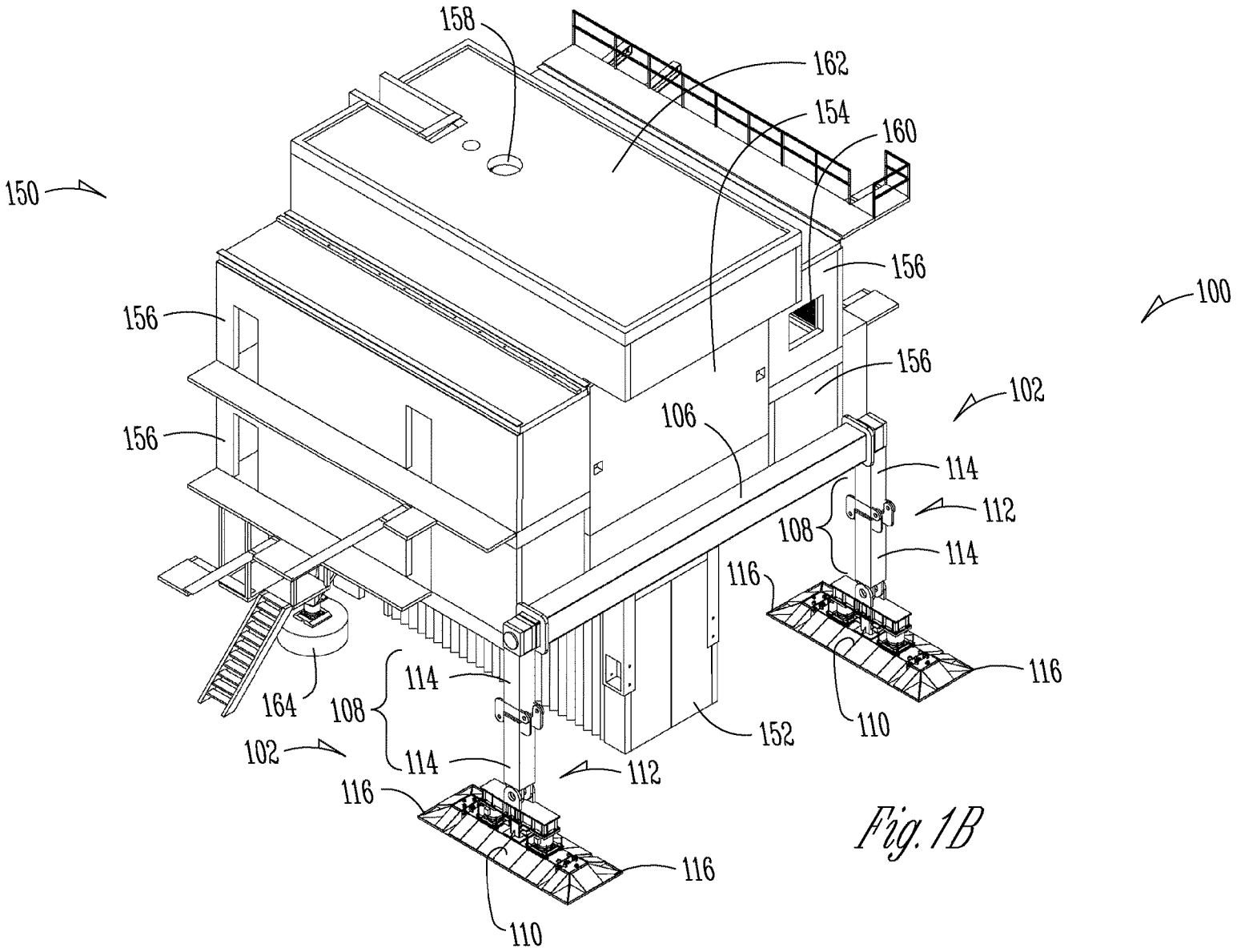
FIG. 1B is another perspective view of the drill floor support structure and modular cellar of FIG. 1A, with the extension portions of the drill floor support structure retracted, according to one or more embodiments.
Figure 1C:
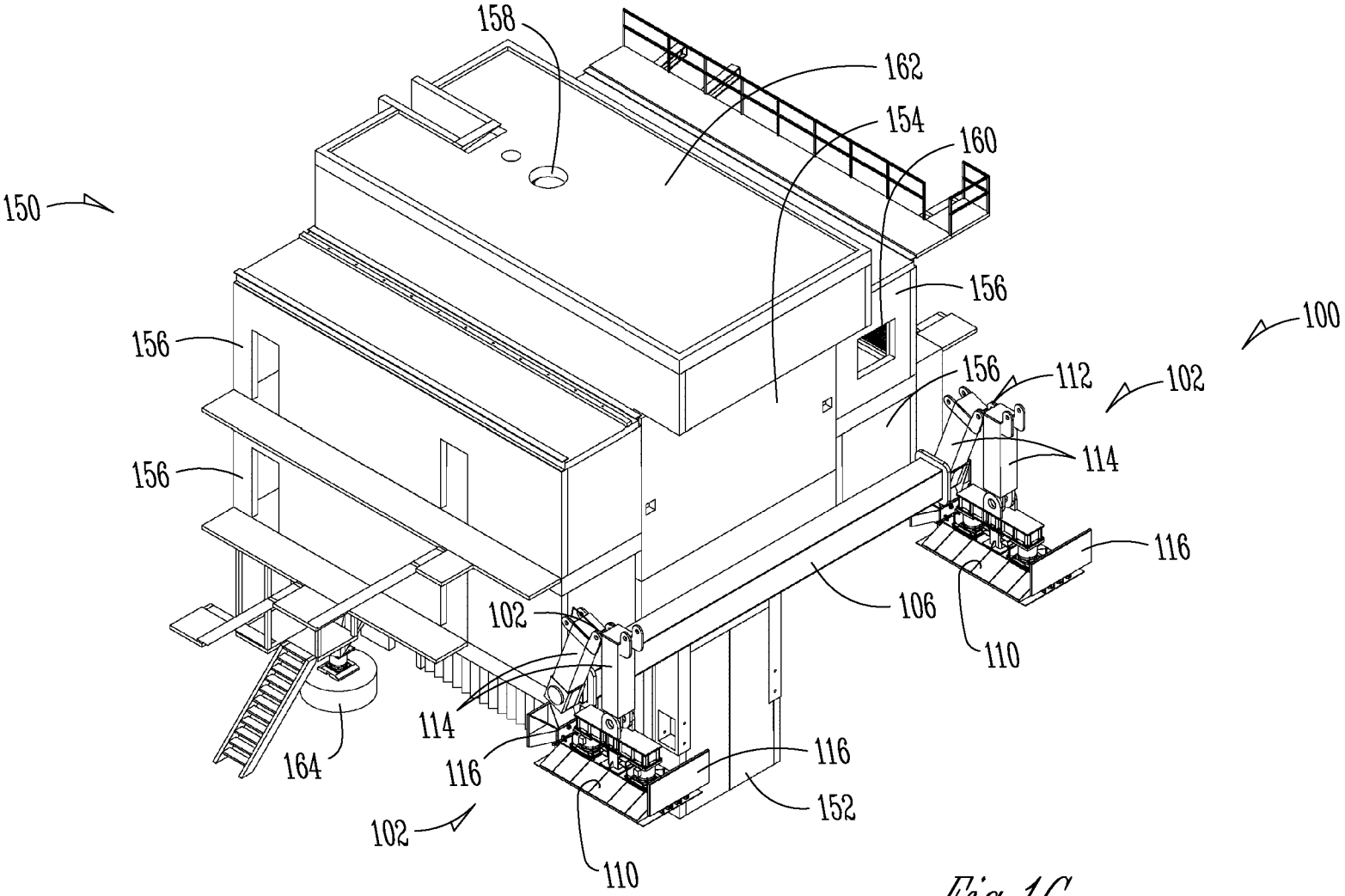
FIG. 1C is another perspective view of the drill floor support structure and modular cellar of FIG. 1A with the column portions of the drill floor support structure retracted, according to one or more embodiments.

Turning now to FIGS. 1A-1C, a drill floor support structure 100 of the present disclosure is shown, according to one or more embodiments. As shown, the drill floor support structure 100 may be coupled to, or arranged on, a modular cellar 150 in some embodiments. However, in other embodiments, the drill floor support structure 100 may be coupled to, or arranged on, a drill floor or another structure or substructure of a drilling rig. The drill floor support structure 100 may have a pair of extendable legs 102. Each leg 102 may have an extension portion and a column portion. Each of the extension portion and column portion may be configured to be operably arranged in a roading position and in one or more operating positions. The extension portion may include an extension member 104 and an outer sleeve 106. The column portion may include a column member 108 extending from an end of the extension member 104 toward a ground or pad surface. A bearing foot 110 may be arranged at an end of each column member 108.

Each extension member 104 may be configured to operably extend or telescope from, and retract into, a corresponding outer sleeve 106. As shown in FIG. 1A, in some embodiments, the extension members 104 for a pair of legs 102 may extend from opposing ends of a same outer sleeve 106. However, in other embodiments, each extension member 104 may extend from, and retract into, separate outer sleeves 106. The outer sleeve(s) 106 may be arranged on the cellar 150, or drill floor or other structure, such that the extension members may extend laterally outward with respect to the cellar. In some embodiments, the extension members 104 may extend generally horizontally. The extension members 104 may extend laterally toward driller and an off-driller sides of the drill rig, respectively.

Each extension member 104 may be or include a hollow or solid member constructed of steel or another suitable metal or combination of metals. In some embodiments, the extension members 104 may each have a square or rectangular cross sectional shape. In other embodiments, the extension members 104 may each have a round or other suitable shape. Each extension member 104 may have any suitable length. In general, the extension members 104 may each have a length configured to extend laterally beyond production piping or other structures surrounding a well head such that the bearing feet may be placed to avoid such structures. In some embodiments, the extension members 104 may have a length of between approximately 5 feet and approximately 30 feet, or between approximately 10 feet and approximately 20 feet. In other embodiments, the extension members 104 may have any other suitable length.

Each outer sleeve 106 may be or include a hollow member sized and shaped to receive the extension members 104, such that the extension members may nestably engage the outer sleeve. In this way, each outer sleeve 106 may have a cross sectional shape and size configured to receive its corresponding extension member 104. Moreover, each outer sleeve 106 may have a length configured to accommodate the length of a corresponding extension member 104, or at least a majority thereof. Where a single outer sleeve 106 receives both extension members 104, as shown for example in FIG. 1A, the sleeve may have a length configured to receive the lengths of both extension members, or the majority thereof. FIGS. 1B-1C illustrate the extension members 104 retracted within the outer sleeve 106, according to some embodiments.

For each leg 102, the column portion may extend between the extension portion and the bearing foot 110 and may be configured to transfer loading to the bearing foot. Each column portion may be or include a hollow or solid column member 108 constructed of steel or another suitable metal or combination of metals. Each column member 108 may have any suitable cross sectional shape and size. In some embodiments, the column members 108 may have a square, rectangular, round, or other suitable cross sectional shape. Each column member 108 may have a length configured to extend between the extension portion and the bearing foot 110 so as to position the bearing foot on a ground or pad surface generally beneath the drill floor during operation.

In some embodiments, for each leg 102, the column portion may be pivotably or rotatably coupled to the extension portion. For example, the column member 108 may be configured to pivot about an axis aligned with a central, longitudinal axis of the extension member 104. FIG. 1C shows the column members 108 pivoted about their connections to the extension members 104, according to some embodiments. In some embodiments, the column members 108 may be configured to pivot or rotate 360 degrees. In other embodiments, the column members 108 may be configured to pivot or rotate up to 270, 180, 90 or any other suitable degree of rotation. In some embodiments, the column members 108 may generally be configured to pivot between one or more operating positions, as shown in FIGS. 1A and 1B, and a roading position, as shown in FIG. 1C. In an operating position, the column members 108 may be positioned to extend between the extension members 104 and a ground or pad surface, generally vertically or at an angle from vertical, so as to position the bearing feet 110 on the ground or pad surface. In the roading position, the column members 108 may be positioned such that the bearing feet 110 are rotated up off of the ground or pad surface so as to help clear production piping and/or other structures. In some embodiments, the column members 108 may be configured to be positioned at any rotational point between the operating and roading positions.

In some embodiments, each column member 108 may have one or more joints 112 configured to divide the member into two pivotably connected sections 114. For example, a joint 112 may be located at a mid-point or approximate mid-point to divide the column member 108 into two sections 114 of approximately the same length. In other embodiments, the joint 112 may be located at a different point along the length of the column member 108. The column members 108 may have more than one joint 112 in some embodiments. Each joint 112 may be a pinned connection. For example, a first pin at each joint may be arranged through aligned lugs or ears of the two column sections 114, such that the second column section may pivot about the pinned connection, as shown in FIG. 1C. A second pin may be arranged through aligned lugs or ears on the two column sections 114 to lock the joint or to generally prevent the second section from pivoting, as shown in FIG. 1A. Foldable or jointed column members 108 may help to keep the legs 102 and/or bearing feet 110 clear of production piping and/or other structures in a roading position and/or as the legs extend or transition to an operating position.

With continued reference to FIGS. 1A-1C, each bearing foot 110 may be pivotably coupled to its corresponding column member 108. The bearing foot 110 may be coupled to an end of the column member 108, opposing an end where the column member couples to the extension member 104. In some embodiments, each bearing foot 110 may couple to a column member 108 with a load cell pin or other load monitoring device so as to monitor loading on the bearing foot. Each bearing foot 110 may have any suitable shape. For example, a bearing foot 110 may have a rectangular cross sectional shape, as shown in FIGS. 1A-1C. A rectangular shaped bearing foot 110 may help to maximize available ground pressure with a relatively large footprint configured for a relatively small space. However, in other embodiments, bearing feet 110 may have square, round, or other suitable shapes.

In some embodiments, the bearing feet 110 may have one or more pivotable or removable sections 116. As shown for example in FIG. 1C, one or more ends 116 of each bearing foot 110 may be pivotable, such that the end(s) may fold or pivot upward. The pivotable sections 116 may fold or pivot from an operating position approximately 90 degrees to a roading position. In other embodiments, the end sections 116 may be removable. The pivotable or removable bearing foot sections 116 may help to reduce the clearance needed for the bearing foot 110 in a roading position or as the legs 102 transition between a roading position to an operating position.

Additionally or alternatively, in some embodiments, bearing feet 110 of the present disclosure may be configurable. For example, one or more sections 116 of a bearing foot 110 may be configured to be removed and repositioned at a different location of the bearing foot. Bearing foot sections 116 may be unpinned and repined (or otherwise decoupled and coupled) to different locations on the bearing foot 110 configured to receive the sections. This may allow bearing feet 110 to be configured with different footprints, depending on the geometry and space constrains around a particular well head.

It is to be appreciated that an operating position of the legs 102, including an operating position of the extension portion and an operating position of the column portion, may depend on the particular geometry or spacing constrains around a particular well head. For example, in some embodiments, the legs 102 may be placed in an operating position with the extension members 104 extended to their full length from the outer sleeve(s) 106. However, in other embodiments, the legs 102 may be placed in an operating position with the extension members 104 only partially extended, or not extended, from the outer sleeve(s) 106. Additionally, in some embodiments and as generally described above, legs 102 of the support structure may be independently drivable or independently actuable. For example, one extension member 104 may be fully extended from the sleeve 106, while the extension member of a second leg 102 may be only partially extended while the legs are in an operating position. In this way, the legs 102 and/or bearing feet 110 may be configured as needed to accommodate asymmetrical geometries or space constraints around a particular well head.

As shown in FIGS. 1A-1C, in some embodiments, the support structure 100 may be arranged on or coupled to a modular cellar 150 configured for arranging beneath a drill floor of a drill rig. The cellar 150 may be configured to house drilling equipment, such as well head equipment. For example, the cellar 150 may house one or more blowout preventers and/or other well head equipment. In some embodiments, the cellar 150 may provide work areas, such that the well head equipment may be prepared, tested, or generally operated within the cellar. In some embodiments, the cellar 150 may be or include a trailer or may otherwise be configured to be mobile or towable. For example, the cellar 150 may be arranged on a towable frame having one or more pairs of wheels or tires and/or skidding feet. The cellar 150 or cellar trailer may be towable, skiddable, and/or walkable in some embodiments. A modular cellar 150 of the present disclosure may generally allow work to begin on a well without the drilling rig present, and may additionally allow work to be completed on a well without the drilling rig present, which may decrease overall drilling operation time.

The modular cellar 150 may generally include a housing with a lower cellar area 152, a mezzanine 154, and one or more subassemblies 156 arranged around the mezzanine. The housing may be configured to house one or more blowout preventers, such as a main blowout preventer and/or other drilling equipment. The housing may be configured to provide an enclosed or partially enclosed environment around the well head to contain gasses. The housing may additionally be configured to provide one or more enclosed work environments for workers, thus providing protection from the environment. In some embodiments, the housing or a portion thereof may be climate controlled. For example, with respect to Arctic drilling operations, the housing or a portion thereof may be heated.

The lower cellar area 152 may be configured to provide a housing for a well head. In some embodiments, the lower cellar area 152 may additionally store equipment, such as a diverter blowout preventer and/or other drilling equipment. In some embodiments, the lower cellar area 152 may have hoisting and/or handling equipment for moving the diverter, blowout preventer, and/or other equipment. The lower cellar area 152 may generally be formed by sidewalls configured to extend around a well head. In some embodiments, the sidewalls may be retractable and/or readily removable so as to allow the cellar 150 to be moved over or across equipment and/or well heads.

The mezzanine 154 may be an enclosure generally arranged over the lower cellar area 152 and configured to house equipment, such as but not limited to, a main blowout preventer. The mezzanine 154 may generally have a ceiling portion 162, four wall portions, and a floor portion (not shown) defining the enclosure. Each of the floor and ceiling 162 portions may have an opening 158 configured to accommodate a well pipe. The mezzanine 154 may have a height configured to accommodate a main blowout preventer and/or other drilling equipment. Additionally, however, the mezzanine 154 may have a height configured to be arranged beneath a drill floor.

The subassemblies 156 may be enclosures arranged around the mezzanine 154, such as along one or more walls of the mezzanine. The subassembly enclosures 156 may provide additional work areas and/or equipment storage space beyond the mezzanine 154. Each subassembly enclosure 156 may be divided into multiple rooms or work or storage areas. In some embodiments, the subassembly enclosures 156 may be arranged in a stacked configuration to provide multiple levels of work or storage space. For example, a lower level subassembly 156 and an upper level subassembly may be arranged on each of a driller side and an off-driller side of the mezzanine 154. In some embodiments, the various enclosures 156 may have different sizes. It may be appreciated that in other embodiments, subassembly enclosures 156 may be arranged differently with respect to one another and/or with respect to the mezzanine 154.

In some embodiments, the housing may have one or more openings 160 configured to accommodate one or more crane rails for moving equipment into and out of the housing. For example, as shown in FIGS. 1A-1C, an opening 160 may be arranged in a wall of at least one of the subassemblies 156.

In some embodiments, the cellar 150 may be configured to abut and/or couple to a drill floor of a drilling rig. That is, the ceiling portion 162 of the mezzanine 154, for example, may be configured to abut an underside of the drill floor when the cellar 150 is arranged beneath the drill floor. In this way, the ceiling portion 162, or another component arranged thereon, may have a relatively flattened surface configured to receive and/or abut the drill floor. Additionally, the cellar 150 may be configured to couple to the drill floor via one or more hydraulic pins and/or other suitable coupling mechanisms. In some embodiments, the ceiling portion 162 of the mezzanine 154 may operate as a drip pan when beneath the drill floor.

In some embodiments, the cellar 150 may have one or more inner bearing feet 164 in addition to bearing feet 110 arranged on the drill floor support structure 100. As shown in FIGS. 1A-1C for example, the cellar 150 may have a pair of inner bearing feet 164, with one inner bearing foot arranged on each of a driller side and an off-driller side of the cellar. The inner bearing feet 164 may help to stabilize the cellar 150 and may additionally transfer a portion of dead loads, hook loads, and/or other loading to a ground or pad surface. In this way, the inner bearing feet 164 may draw some loading from the bearing feet 110 of the drill floor support structure 100. In some embodiments, the inner bearing feet 164 may be configured to be arranged in one or more positions, such as an operating position where the bearing feet are arranged on a ground or pad surface, and a roading position where the bearing feet are retracted or lifted up above the ground or pad surface. In some embodiments, the inner bearing feet 164 may have a walking or skidding mechanism and/or may allow for bi-directional movement of the cellar 150. In some embodiments, the cellar 150 may additionally or alternatively have one or more tires or pairs of tires or wheels. In some embodiments, the tires may be configured to be removed during drilling and/or other operations.

In some embodiments, the cellar 150 may similar to those described in, or may include components or elements described in, U.S. Non-Provisional application Ser. No. 15/451,968, entitled Multi-Well BOP Cellar Trailer and filed Mar. 7, 2017, the content of which is hereby incorporated by reference herein in its entirety.

Figure 2A:
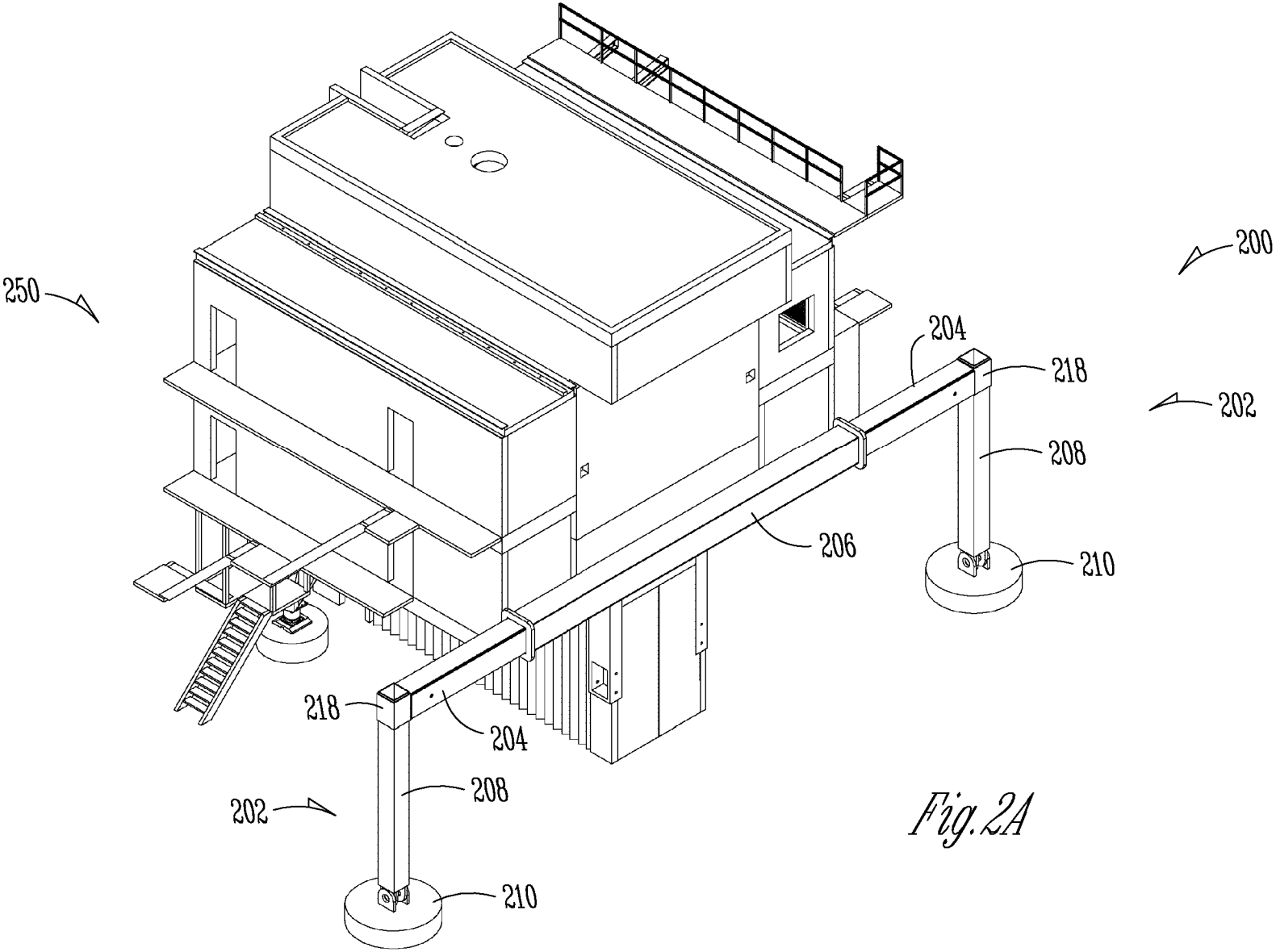
FIG. 2A is a perspective view of a drill floor support structure and a modular cellar of the present disclosure, with the extension portions and column portions of the drill floor support structure extended, according to one or more embodiments.
Figure 2B:
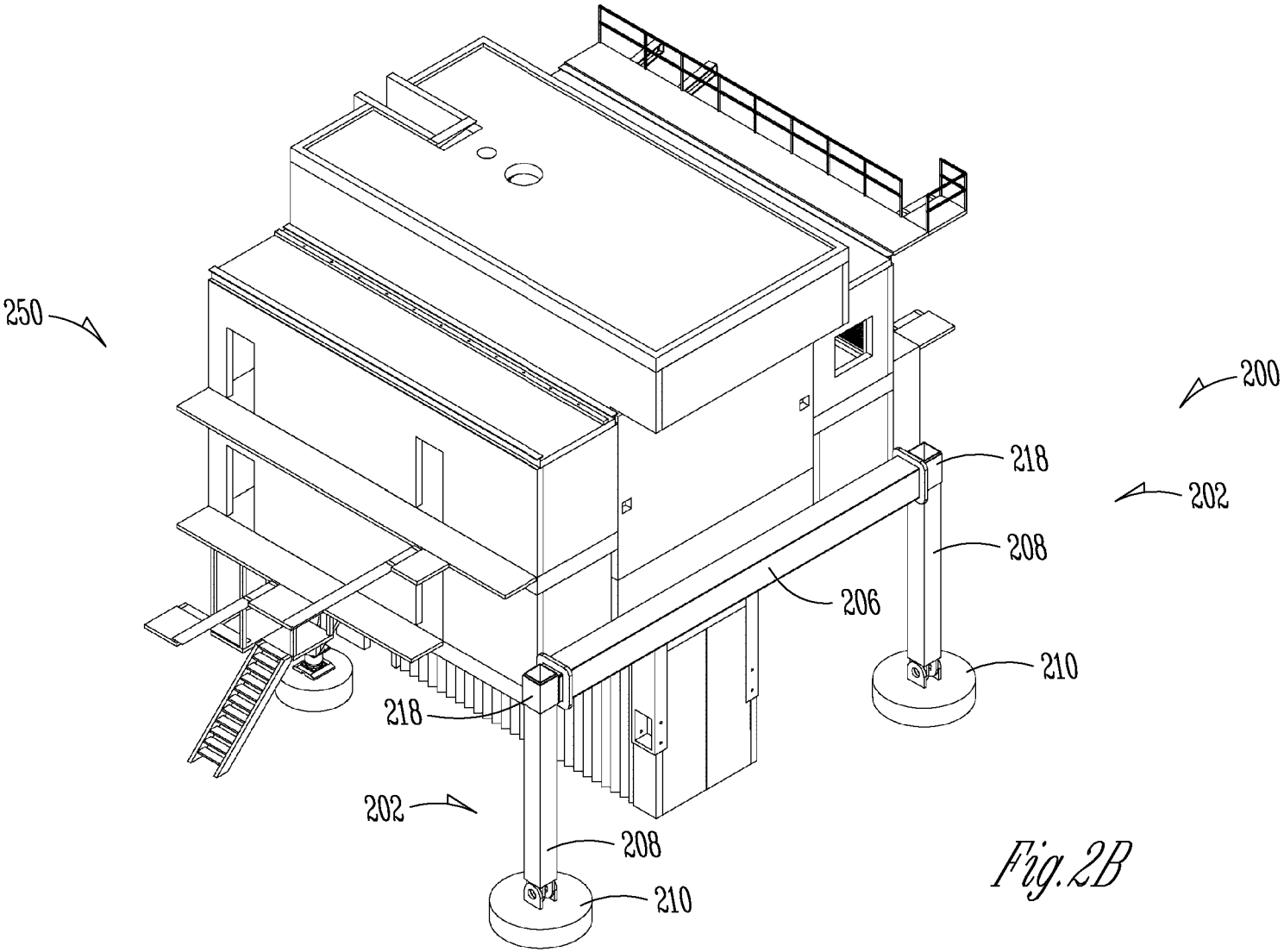
FIG. 2B is another perspective view of the drill floor support structure and the modular cellar of FIG. 2A with the extension portions of the drill floor support structure retracted, according to one or more embodiments.
Figure 2C:
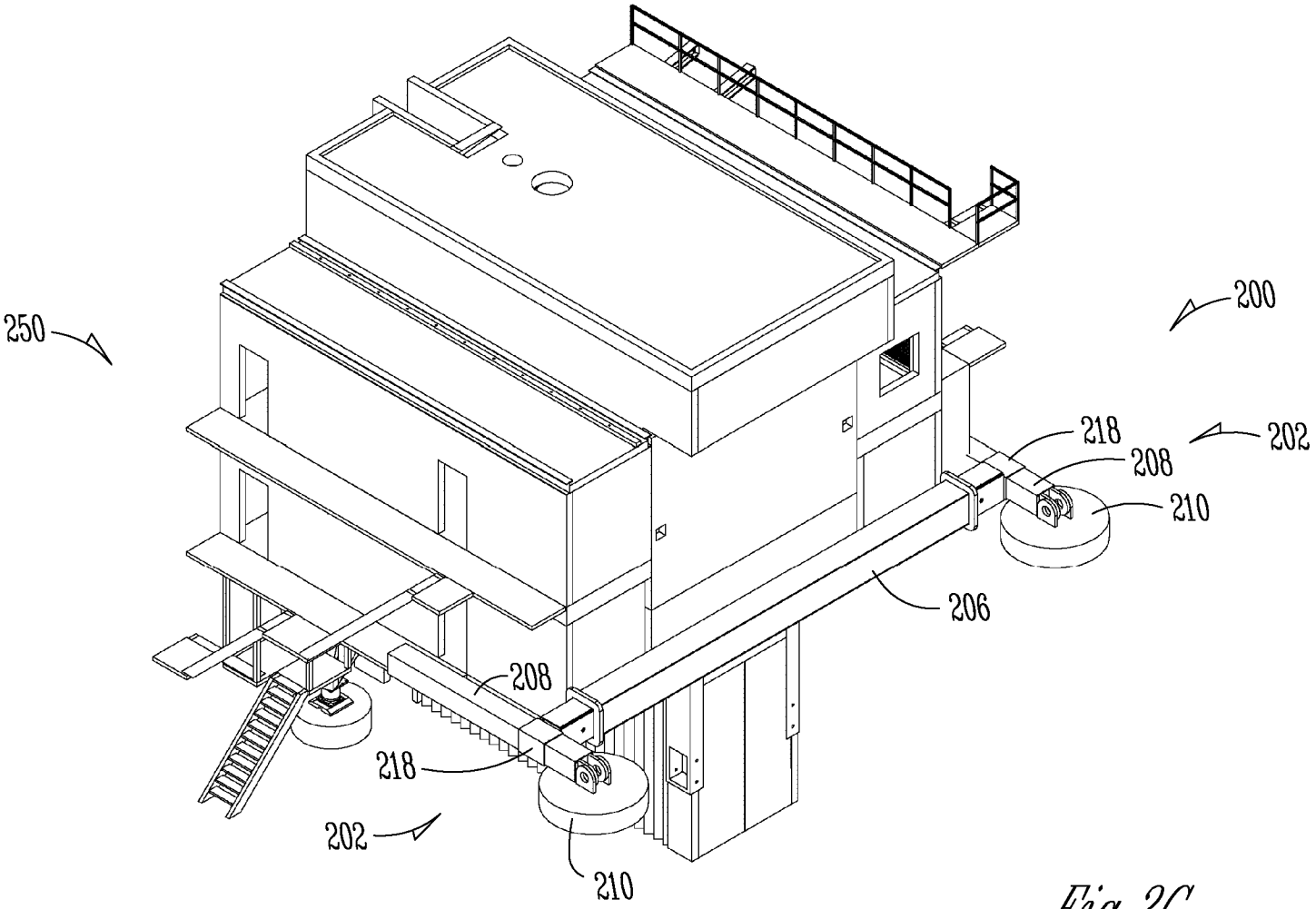
FIG. 2C is another perspective view of the drill floor support structure and modular cellar of FIG. 2A with the column portions retracted, according to one or more embodiments.

Turning now to FIGS. 2A-2C, another drill floor support structure 200 of the present disclosure is shown. As shown, the drill floor support structure 200 may be coupled to, or arranged on, a modular cellar 250, which may be similar to the modular cellar 150 discussed above with respect to FIGS. 1A-1C. However, in other embodiments, the drill floor support structure 200 may be coupled to, or arranged on, a drill floor or another structure or substructure of a drilling rig. The drill floor support structure 200 may have a pair of extendable legs 202. Each leg 202 may have an extension portion and a column portion. Each of the extension portion and column portion may be configured to be operably arranged in a roading position and in one or more operating positions. The extension portion may include an extension member 204 and an outer sleeve 206. The column portion may include a column member 208 extending from an end of the extension member 204 toward a ground or pad surface. The column portion may additionally include a collar 218 for adjusting an operating length of the column member 208. A bearing foot 210 may be arranged at an end of each column member 208.

The extension portions may be similar to those discussed above with respect to FIGS. 1A-1C. In particular, each extension member 204 may be configured to operably extend or telescope from, and retract into, a corresponding outer sleeve 206. The extension members 204 and outer sleeves 206 may be sized and shaped similar to those discussed above with respect to FIGS. 1A-1C.

For each leg 202, the column portion may extend between the extension portion and the bearing foot 210 and may be configured to transfer loading to the bearing foot. Each column portion may be or include a hollow or solid column member 208 constructed of steel or another suitable metal or combination of metals. Each column member 208 may have any suitable cross sectional shape and size. In some embodiments, the column members 208 may have a square, rectangular, round, or other suitable cross sectional shape. Each column member 208 may have a length configured to extend between the extension portion and the bearing foot 210 so as to position the bearing foot on a ground or pad surface generally beneath the drill floor during operation.

In some embodiments, each column member 208 may be configured to scope through a collar 218 so as to extend or retract the column member. That is, the collar 218 may be a hollow bracket or sheath with open ends that may be sized and shaped to receive and slidingly engage the column member 208. For example, and as shown in FIGS. 2A-2C, where the column member 208 has a square cross sectional shape, the collar 218 may have a square cross sectional shape sized to allow the column member to pass through the collar. The collar 218 may have any suitable length shorter than that of the column member 208. The column member 208 may be configured to slide through the collar 218 between an operating position and a roading position. In an operating position, as shown for example in FIGS. 2A and 2B, the column member 208 may be extended between the collar 218 and a ground or pad surface such that the bearing foot 210 may be arranged on the ground or pad surface. Moreover, in the operating position, the collar 218 may generally be arranged at or near a first end of the column member 208. In a roading position, the column member 208 may pulled through the collar 218 to pull the bearing foot 210 toward the extension portion, as shown for example in FIG. 2C. In the roading position, the collar 218 may generally be arranged at or near a second end of the column member 208, the second end opposing the first end. In some embodiments, the column member 208 may be configured to be arranged with the collar 218 at any position along its length between the first and second ends. In some embodiments a ball plunger or other mechanism may be configured to engage the column member 208 and/or collar 218 to position the collar at a desired point along the length of the column member.

In some embodiments, for each leg 202, the collar 218 may be pivotably or rotatably coupled to the extension portion. For example, the collar 218 may be configured to pivot about an axis aligned with a central, longitudinal axis of the extension member 204. As the collar 218 pivots about its connection with the extension member 204, the column member 208 may additionally be pivoted about the same axis. FIG. 2C shows the collars 218 pivoted about their connections to the extension members 204, according to some embodiments. In some embodiments, the collars 218 may be configured to pivot or rotate 360 degrees. In other embodiments, the collars 218 may be configured to pivot or rotate up to 270, 180, 90 or any other suitable degree of rotation. In some embodiments, the collars 218 may generally be configured to pivot between an operating position, as shown in FIG. 2A, and a roading position, as shown in FIG. 2C. In the operating position, the collars 218 may be angled to arrange the column members 208 generally vertically or at an angle from vertical, so as to position the column members between the collars and a ground or pad surface to position the bearing feet 210 on the ground or pad surface. In the roading position, the collars 218 may be angled so as to rotate the bearing feet 210 up off of the ground or pad surface. In some embodiments, the collars 218 may be configured to be positioned at any rotational point between the operating and roading positions.

With continued reference to FIGS. 2A-2C, each bearing foot 210 may be pivotably coupled to its corresponding column portion. The bearing foot 210 may be coupled to an end of the column member 208, opposing an end where the column member couples to the extension member 204. In some embodiments, each bearing foot 210 may couple to a column member 208 with a load cell pin or other load monitoring device so as to monitor loading on the bearing foot. Each bearing foot 210 may have any suitable shape. For example, a bearing foot 210 may have a round footprint shape. Round shaped bearing feet 210 may be particularly maneuverable into small or restricted spaces, in part due to an absence of corners on the footprint. However, in other embodiments, bearing feet 210 may have square, rectangular, or other suitable shapes.

Figure 3A:
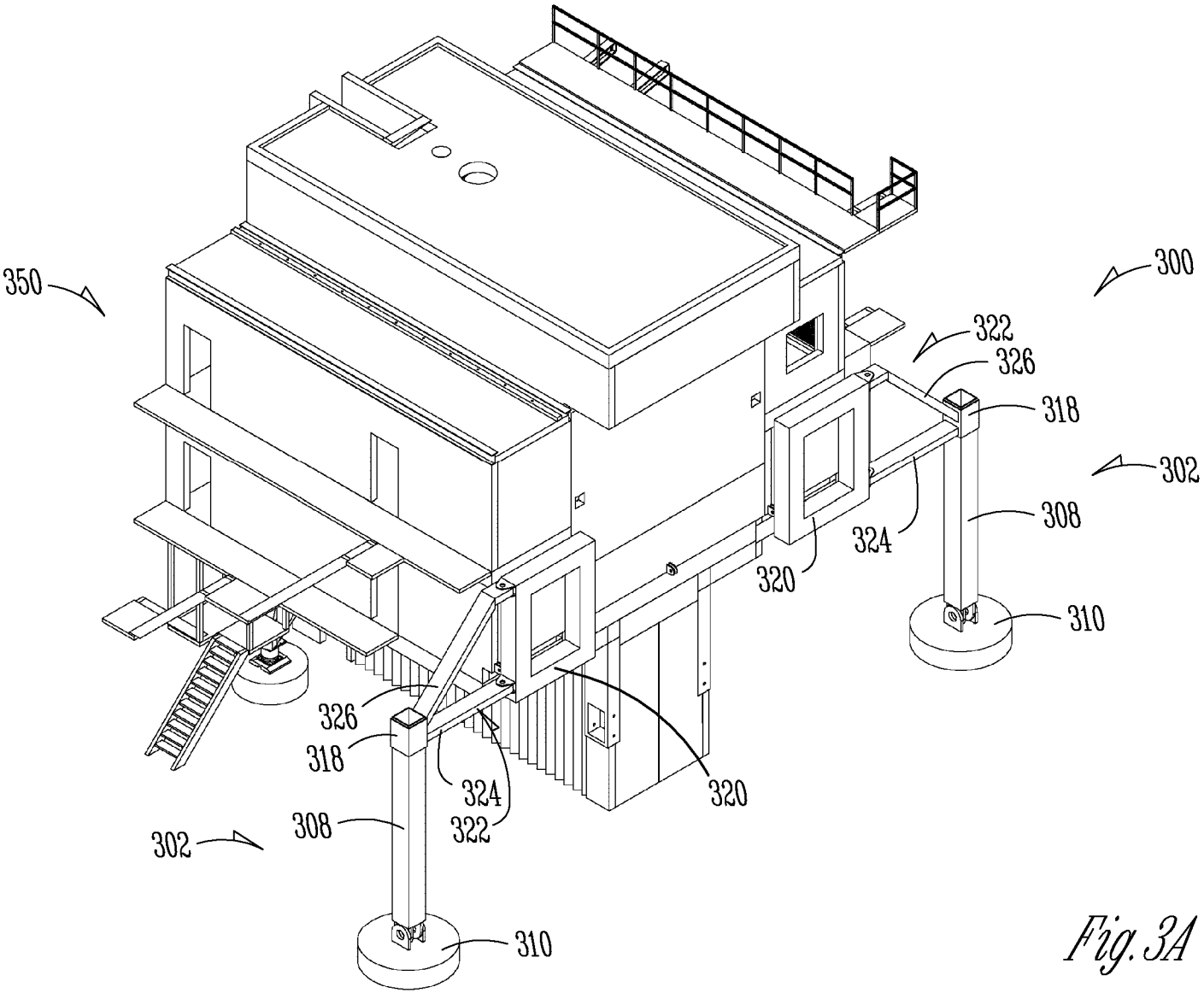
FIG. 3A is a perspective view of a drill floor support structure and a modular cellar of the present disclosure, with the extension portions and column portions of the drill floor support structure extended, according to one or more embodiments.
Figure 3B:
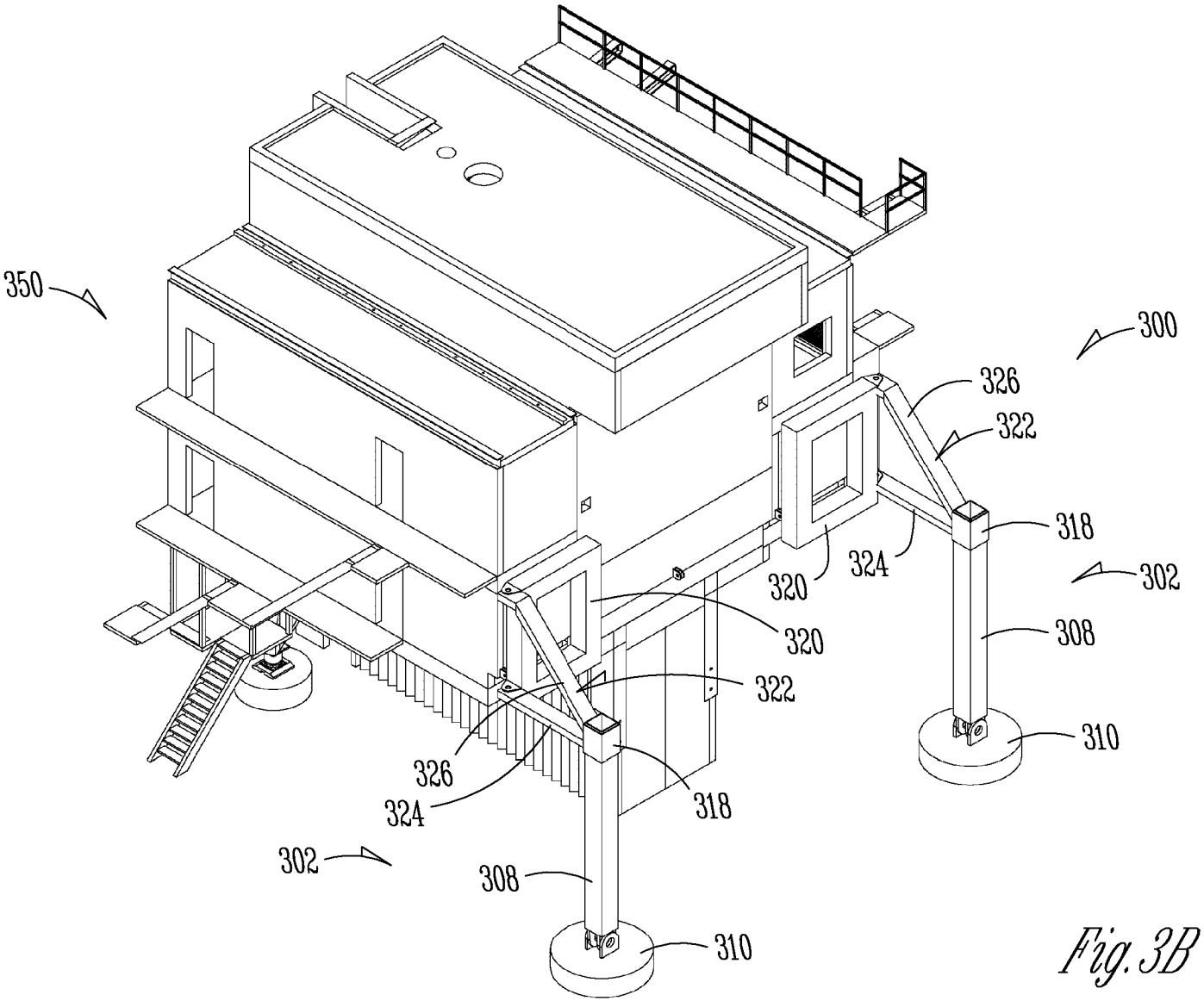
FIG. 3B is another perspective view of the drill floor support structure and the modular cellar of FIG. 3A with the extension portions pivoted to another position, according to one or more embodiments.
Figure 3C:
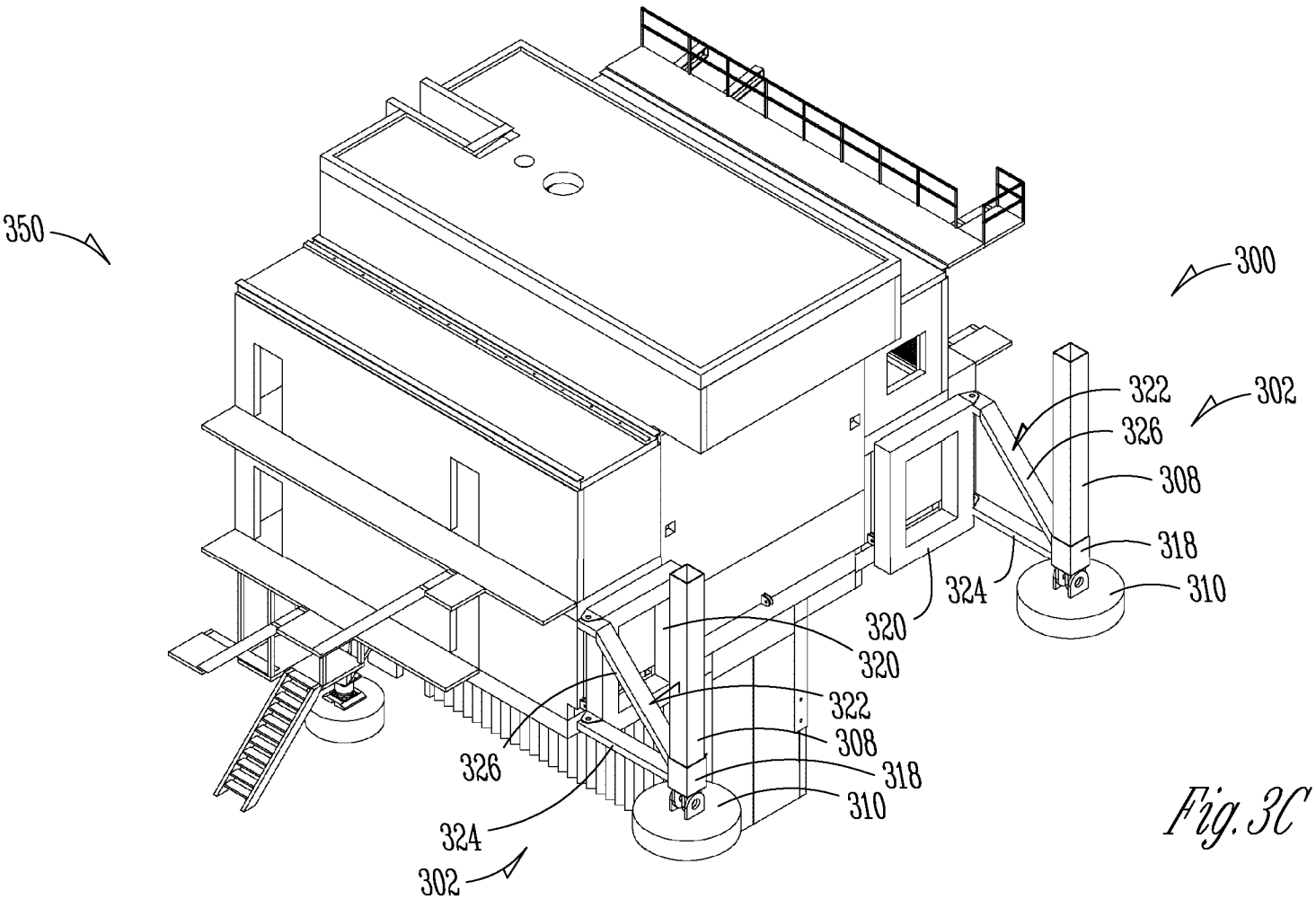
FIG. 3C is another perspective view of the drill floor support structure and the modular cellar of FIG. 3A with the column portions retracted, according to one or more embodiments.

Turning now to FIGS. 3A-3C, another drill floor support structure 300 of the present disclosure is shown. As shown, the drill floor support structure 300 may be coupled to, or arranged on, a modular cellar 350, which may be similar to the modular cellar 150 discussed above with respect to FIGS. 1A-1C. However, in other embodiments, the drill floor support structure 300 may be coupled to, or arranged on, a drill floor or another structure or substructure of a drilling rig. The drill floor support structure 300 may have a pair of extendable legs 302. Each leg 302 may have an extension portion and a column portion. Each of the extension portion and column portion may be configured to be operably arranged in a roading position and in one or more operating positions. The extension portion may include a pivoting frame 322 coupled to a support frame 320. The column portion may include a column member 308 extending from an end of the pivoting frame 322 toward a ground or pad surface. The column portion may additionally include a collar 318 for adjusting an operating length of the column member 308. A bearing foot 310 may be arranged at an end of each column member 308.

For each leg 302, the support frame 320 may be configured to provide a point from which the pivoting frame 322 may pivot laterally. The support frame 320 may include one or a plurality of members. In some embodiments, as shown in FIGS. 3A-3C, the support frame 320 may generally include four members arranged in a square or rectangular shape and affixed to the cellar 350. In other embodiments, the support frame 320 may have any suitable number of frame members arranged in any suitable shape. Each support frame 320 may be configured to be pinned, bolted, or otherwise coupled to a wall of a subassembly of the cellar 350, to a wall of the mezzanine, an existing drilling structure, or to any other suitable surface or location. The member(s) of each support frame 320 may be constructed of steel, other metals, and/or other suitable materials. The support frame 320 members may additionally have any suitable size and shape.

The pivoting frame 322 of each leg 302 may couple to the support frame 320 via one or more hinged connections and may be configured to pivot the leg about a generally vertical axis. The pivoting frame 322 may have one or more, and in some embodiments two, members pivotably coupled to the support frame. A first member 324 of the pivoting frame 322 may extend laterally outward, and generally horizontally, from its hinged connection at the support frame 320 toward the column member 308. A second member 326 of the pivoting frame 322 may be an angled member and may extend laterally and at an angle, such as an angle of approximately 45 degrees, from its pivoted connection at the support frame 320 toward the column member 308. In this way, the first 324 and second 326 members of the pivoting frame 322 may form a triangular frame structure between the support frame 320 and the column member 308. Hinged connections between the two members 324, 326 and the support frame 320 may be aligned such that the first and second members may pivot about a same axis, which may be a generally vertical axis. In other embodiments, the pivoting frame 322 may have other members arranged in any other suitable configuration. One or more members of the pivoting frame 322 may couple to the collar 318 for the column portion. For example, both the first 324 and second 326 members may couple to the collar 318. In other embodiments, one or more members of the pivoting frame 322 may couple directly to the column member 308.

The pivoting frame 322 may generally be configured to pivot in an arc about a generally vertical axis to arrange the legs 302 in a variety of operating positions. In an operating position, each leg 302 may be extended laterally toward a driller or an off-driller side of the cellar 350, as shown for example in FIG. 3A. The pivoting frame 322 may be configured to pivot up to 45 degrees, 90 degrees, up to 120 degrees, up to 180 degrees, or up to any other suitable degree of rotation. The operating position may help to position the legs 302 to avoid production piping and/or other obstacles or structures around a well head. To prepare the legs 302 for a roading position, each leg 302 may be pivoted inward to an innermost pivotable position, as shown for example in FIG. 3B. In other embodiments, the pivoting frame 322 may be configured to pivot to a further or lesser degree.

For each leg 302, the column portion may extend between the pivoting frame 322 and the bearing foot 310 and may be configured to transfer loading to the bearing foot. Each column portion may be or include a hollow or solid column member 308 constructed of steel or another suitable metal or combination of metals. Each column member 308 may have any suitable cross sectional shape and size. In some embodiments, the column members 308 may have a square, rectangular, round, or other suitable cross sectional shape. Each column member 308 may have a length configured to extend between the extension portion and the bearing foot 310 so as to position the bearing foot on a ground or pad surface generally beneath the drill floor.

In some embodiments, each column member 308 may be configured to scope through a collar 318 so as to extend or retract the column member. That is, the collar 318 may be a hollow bracket or sheath with open ends that may be sized and shaped to receive and slidingly engage the column member 308. The collars 318 and scoping mechanisms may be similar to those described above with respect to FIGS. 2A-2C.

In some embodiments, the legs 302 may additionally be configured to scope or telescope generally horizontally or laterally toward a driller and off-driller side of the drill floor or drilling rig. For example, in some embodiments, the support frame 320 and/or pivoting frame 322 may have one or more scoping or telescoping mechanisms. In other embodiments, a generally horizontal telescoping mechanism may couple to an end of the pivoting frame 322, for example.

With continued reference to FIGS. 3A-3C, each bearing foot 310 may be pivotably coupled to its corresponding column portion. The bearing foot 310 may be coupled to an end of the column member 308, opposing an end where the column member couples to the extension portion. In some embodiments, each bearing foot 310 may couple to a column member 308 with a load cell pin or other load monitoring device so as to monitor loading on the bearing foot. Each bearing foot 310 may have any suitable shape. For example, a bearing foot 310 may have a round footprint shape. Round shaped bearing feet 310 may be particularly maneuverable into small or restricted spaces, in part due to an absence of corners on the footprint. However, in other embodiments, bearing feet 310 may have square, rectangular, or other suitable shapes.

Figure 4A:
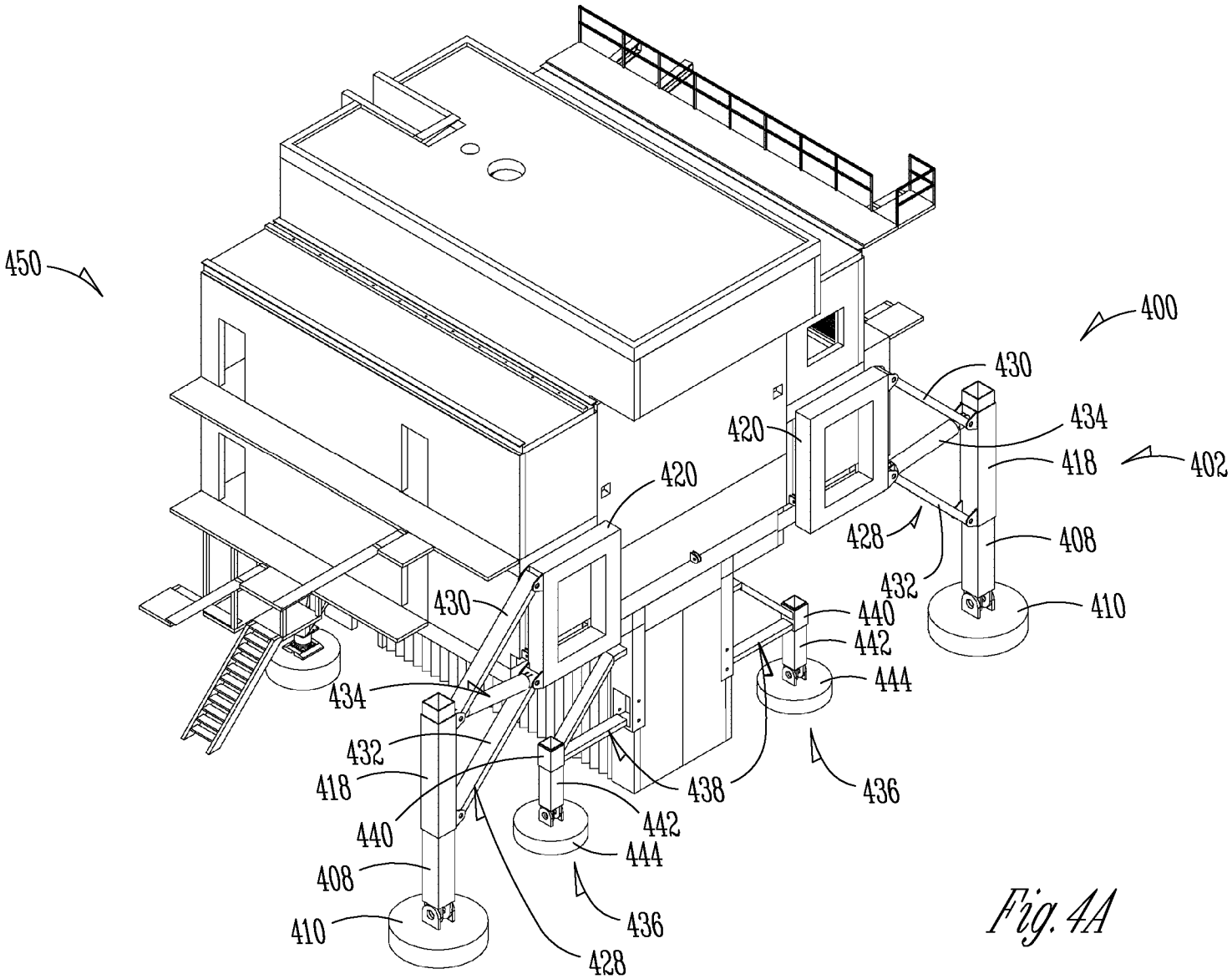
FIG. 4A is a perspective view of a drill floor support structure and a modular cellar of the present disclosure, with the extension portions and column portions of a first pair of legs extended, and the extension portions and column portions of a second pair of legs extended, according to one or more embodiments.
Figure 4B:
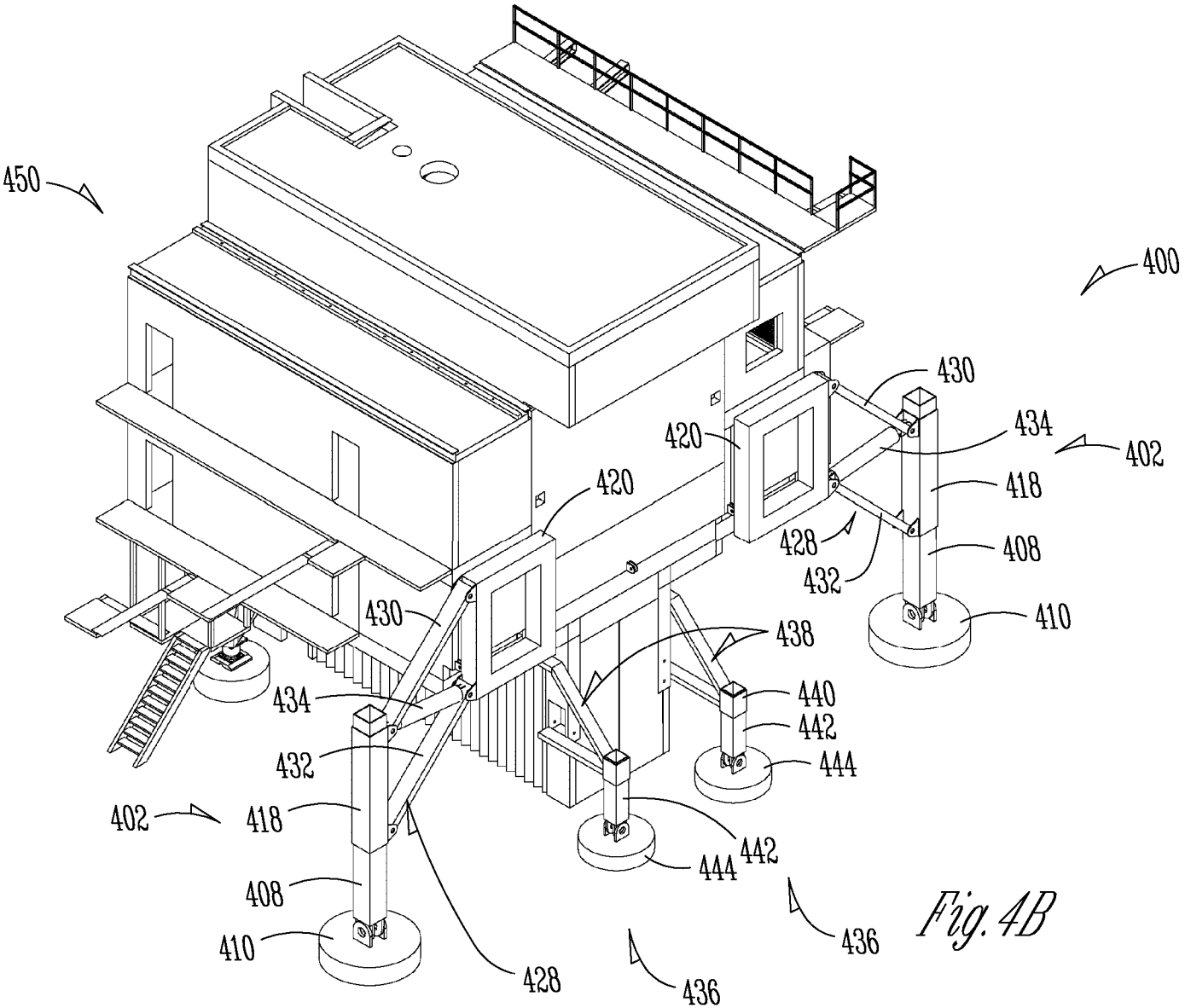
FIG. 4B is another perspective view of the drill floor support structure and modular cellar of FIG. 4A with the extension portions of the second pair of legs of the drill floor support structure pivoted into another position, according to one or more embodiments.
Figure 4C:
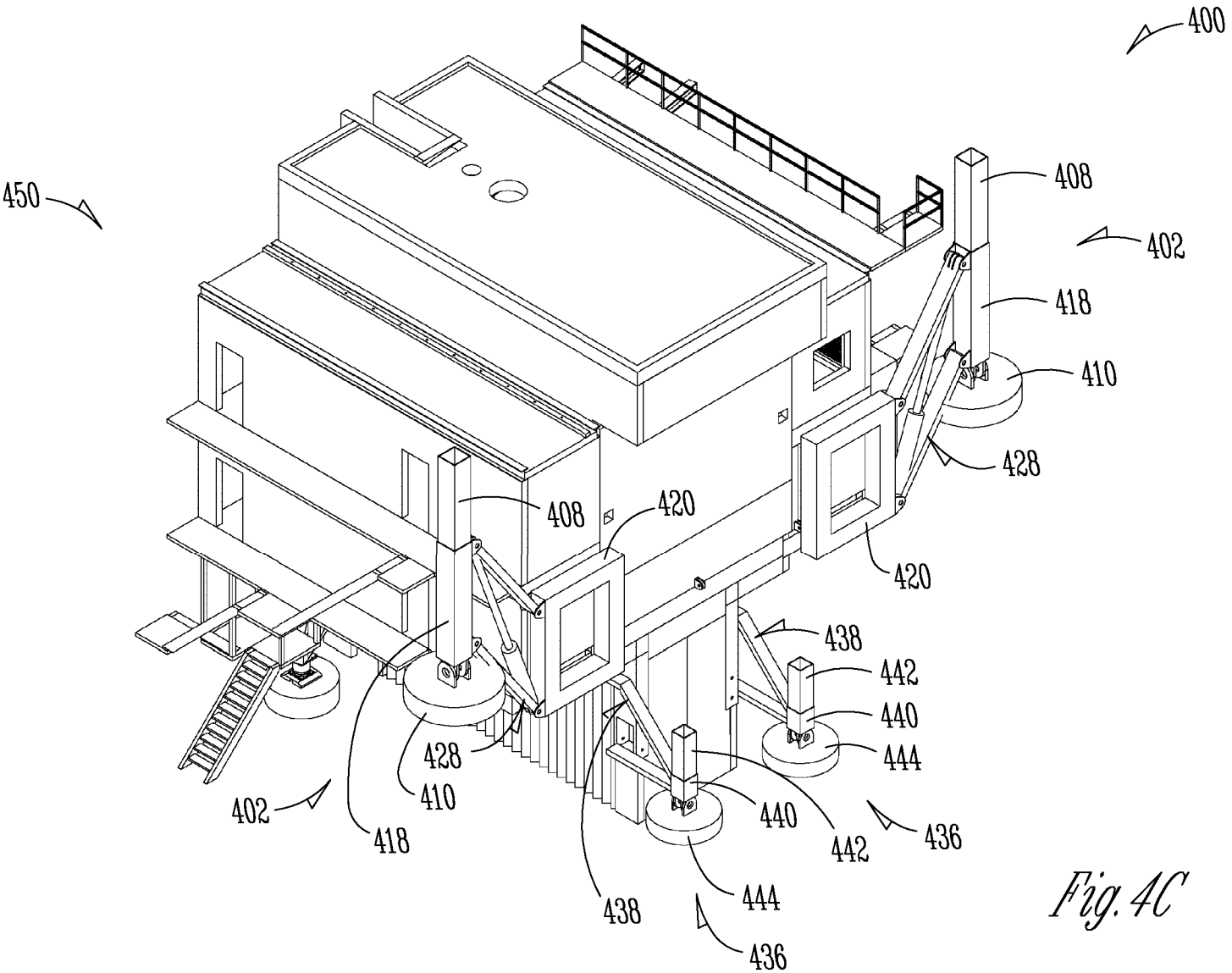
FIG. 4C is another perspective view of the drill floor support structure and modular cellar of FIG. 4A with extension portions and column portions of each of the first and second pairs of legs retracted, according to one or more embodiments.
Figure 5A:
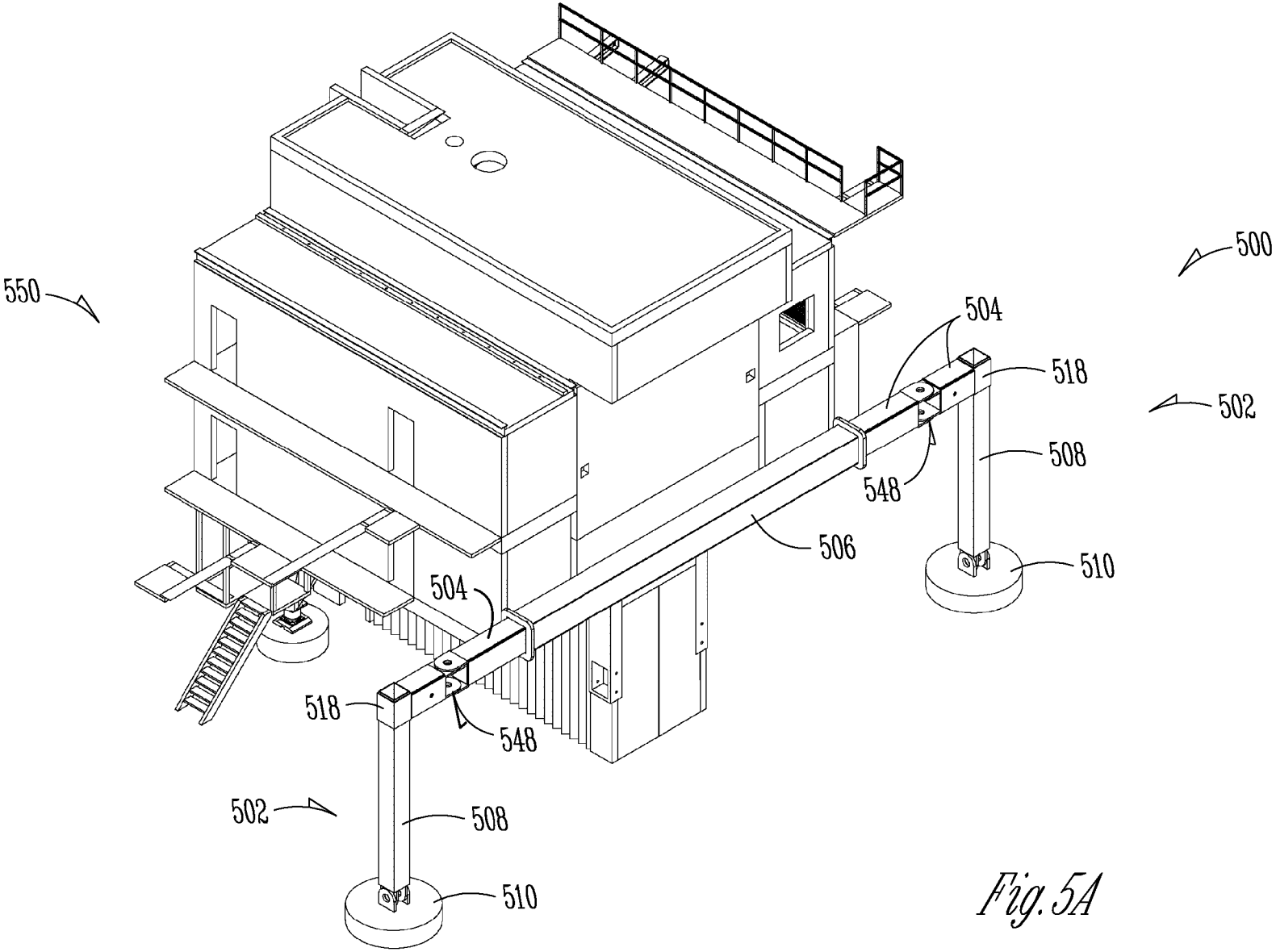
FIG. 5A is a perspective view of a drill floor support structure and a modular cellar of the present disclosure, with the extension portions and column portions of the drill floor support structure extended, according to one or more embodiments.
Figure 5B:
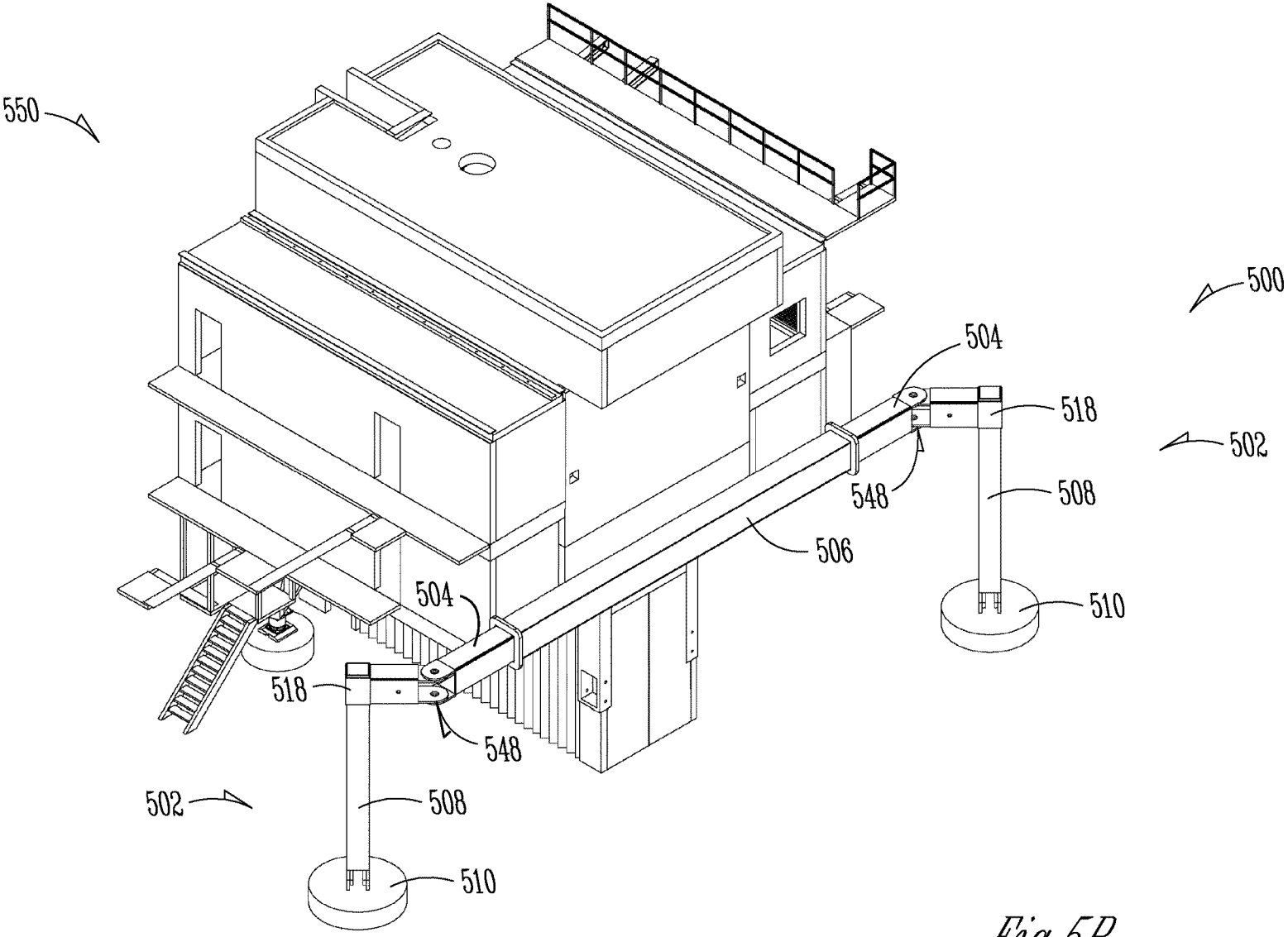
FIG. 5B is another perspective view of the drill floor support structure and modular cellar FIG. 5A, with the extension portions pivoted to another position, according to one or more embodiments.
Figure 5C:
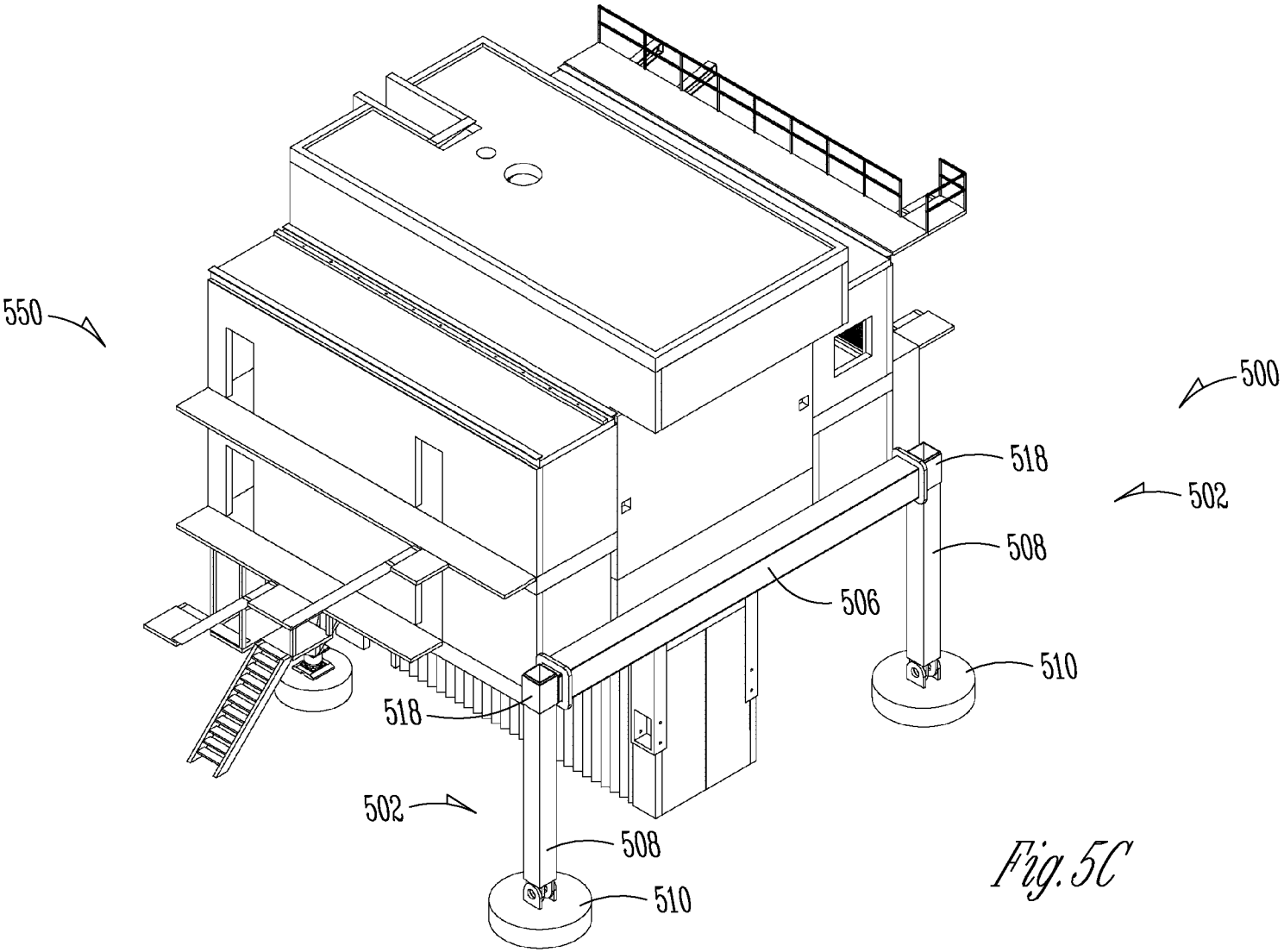
FIG. 5C is another perspective view of the drill floor support structure and modular cellar of FIG. 5A, with the extension portions retracted, according to one or more embodiments.
Figure 5D:
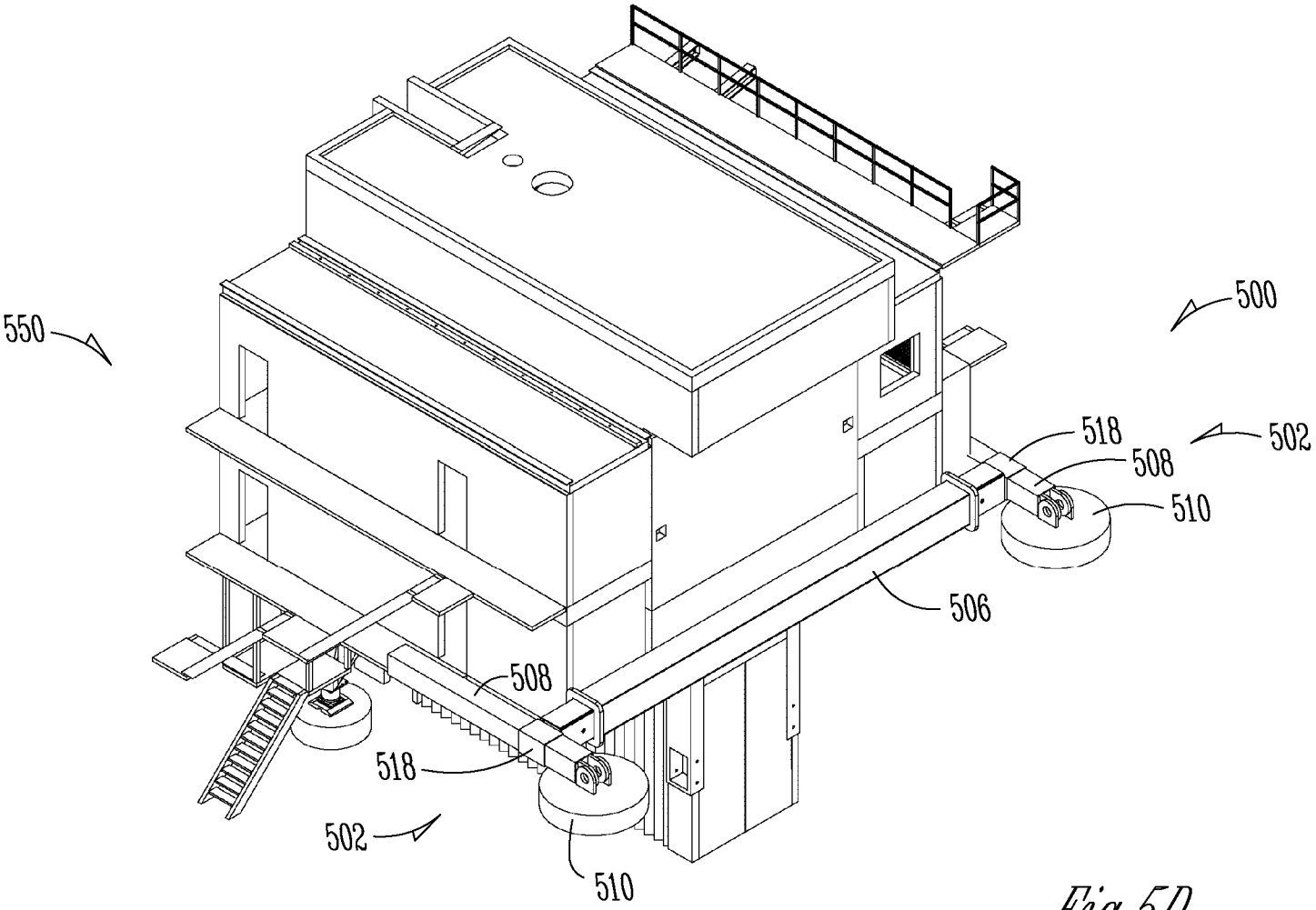
FIG. 5D is another perspective view of the drill floor support structure and modular cellar of FIG. 5A, with the column portions retracted, according to one or more embodiments.

Turning now to FIGS. 4A-4C, another drill floor support structure 400 of the present disclosure is shown. As shown, the drill floor support structure 400 may be coupled to, or arranged on, a modular cellar 450, which may be similar to the modular cellar 150 discussed above with respect to FIGS. 1A-1C. However, in other embodiments, the drill floor support structure 400 may be coupled to, or arranged on, a drill floor or another structure or substructure of a drilling rig. The drill floor support structure 400 may have a pair of extendable legs 4025. Each leg 402 may have an extension portion and a column portion. Each of the extension portion and column portion may be configured to be operably arranged in a roading position and in one or more operating positions. The extension portion may include a retractable frame 428 coupled to a support frame 420. The column portion may include a column member 408 extending from the retractable frame toward a ground or pad surface. The column portion may additionally include a collar 418 for adjusting an operating length of the column member 408. A bearing foot 410 may be arranged at an end of each column member 408.

For each leg 402, the support frame 420 may be configured to provide a point from which the retractable frame 428 may pivotably retract and extend the column portion. The support frame 420 may include one or a plurality of members. In some embodiments, as shown in FIGS. 4A-4C, the support frame 420 may generally include four members arranged in a square or rectangular shape and affixed to the cellar. In other embodiments, the support frame 420 may have any suitable number of frame members arranged in any suitable shape. Each support frame 420 may be configured to be pinned, bolted, or otherwise coupled to a wall of a subassembly of the cellar 450, to a wall of the mezzanine, or to any other suitable surface or location. The member(s) of each support frame 420 may be constructed of steel, other metals, and/or other suitable materials. The support frame 420 members may additionally have any suitable size and shape.

For each leg 402, the retractable frame 428 may be configured to operatively retract and expand between one or more operating positions and a roading position, and generally to any suitable position therebetween. In some embodiments, the retractable frame 428 may include one or a plurality of members 430, 432 arranged between the support frame 420 and the column portion. One or more members 430, 432 of the retractable frame 428 may be pivotably coupled at a first end to the support frame 420 and may be pivotably coupled at a second end to the column portion, such as to the collar 418. At each pivoted connection, the member 430, 432 may be configured to pivot about a generally horizontal axis. In some embodiments, the retractable frame 428 may include a hydraulic cylinder 434 pivotably coupled to each of the support frame 420 and the column portion. At each pivotable connection, the hydraulic cylinder 434 may additionally be configured to rotate about a generally horizontal axis. The hydraulic cylinder 434 may be configured to operatively retract and extend the retractable frame 428. For example, as shown in FIGS. 4A-4B, when a piston of the hydraulic cylinder 434 is withdrawn into the cylinder, the retractable frame 428 may be expanded to an operating position so as to arrange the bearing foot 410 on a ground or pad surface. As shown in FIG. 4C, extension of the hydraulic cylinder 434 piston may cause the retractable frame 428 to retract or raise upward into a roading position so as the cylinder and each of the pivotably coupled members pivot about their connections to the support frame 420 and the column portion. Additionally, in some embodiments, the retractable frames 428 may be configured to retract or extend to any position between the operating position and roading position, such that the legs 402 may be arranged to accommodate differing geometries or substructures around different well heads.

For each leg 402, the column portion may extend between the retractable frame 428 and the bearing foot 410 and may be configured to transfer loading to the bearing foot. Each column portion may be or include a hollow or solid column member 408 constructed of steel or another suitable metal or combination of metals. Each column member 408 may have any suitable cross sectional shape and size. In some embodiments, the column members 408 may have a square, rectangular, round, or other suitable cross sectional shape. Each column member 408 may have a length configured to extend between the extension portion and the bearing foot 410 so as to position the bearing foot on a ground or pad surface generally beneath the drill floor during operation.

In some embodiments, each column member 408 may be configured to scope through a collar 418 so as to extend or retract the column members. That is, the collar 418 may be a hollow bracket or sheath with open ends that may be sized and shaped to receive and slidingly engage the column member 408. The collars 418 and scoping mechanisms may be similar to those described above with respect to FIGS. 2A-2C.

With continued reference to FIGS. 4A-4C, each bearing foot 410 may be pivotably coupled to its corresponding column member 408. The bearing foot 410 may be coupled to an end of the column member 408, opposing an end where the column member couples to the extension portion. In some embodiments, each bearing foot 410 may couple to a column member 408 with a load cell pin or other load monitoring device so as to monitor loading on the bearing foot 410. Each bearing foot 410 may have any suitable shape. For example, a bearing foot 410 may have a round footprint shape. Round shaped bearing feet 410 may be particularly maneuverable into small or restricted spaces, in part due to an absence of corners on the footprint. However, in other embodiments, bearing feet 410 may have square, rectangular, or other suitable shapes.

In some embodiments, the drill floor support structure 400 may include a second pair of legs 436. The second pair of legs 436 may generally employ any, or any combination of, the mechanisms described above. For example, the second pair of legs 436 may be configured to pivot, hinge, fold, retract, extend, telescope, and/or scope. In some embodiments, the second pair of legs 436 may be separately coupled to the cellar 450, drill floor, or to another substructure or surface. As shown in FIGS. 4A-4C for example, the second pair of legs 436 may be coupled to the lower cellar. The second pair of legs 436 may generally be configured to transfer a portion of loading, such as dead loads, hook loads, and/or other loading, from the drill floor to a ground or pad surface. In this way, the second pair of legs 436 may reduce the amount of loading on the first pair of legs 402. In at least one embodiment, each leg 436 of the second pair of legs may include an extension portion, a column portion, and a bearing foot 444. The extension portion may include a pivoting frame 438, and the a column portion may include a column member 442 and a collar 440.

For each leg 436, the pivoting frame 438 may be similar to those discussed above with respect to FIGS. 3A-3C. The pivoting frame 438 may couple directly to the lower cellar or to another surface or structure of the cellar 450, for example. In other embodiments, the pivoting frame 438 may couple to a support frame arranged on the cellar 450. The pivoting frame 438 may generally be configured to pivot in an arc about a generally vertical axis to arrange the legs 436 in a variety of operating positions. In an operating position, each leg 436 may be extended laterally toward a driller or an off-driller side of the cellar 450, as shown for example in FIG. 4A. To prepare the legs 436 for a roading position, each leg 436 may be pivoted inward to an innermost pivotable position, as shown for example in FIGS. 4B and 4C.

For each leg 436, the column portion may extend between the pivotable frame 438 and the bearing foot 444 and may be configured to transfer loading to the bearing foot. In some embodiments, the column portion may be similar to those discussed above. For example, the column portion may include a hollow or solid column member 442 configured to scope through a collar 440 so as to extend or retract the column portion.

With continued reference to FIGS. 4A-4C, each bearing foot 444 of the second pair of legs 436 may be pivotably coupled to an end of its corresponding column member 442. In some embodiments, each bearing foot 444 may couple to a column member 442 with a load cell pin or other load monitoring device so as to monitor loading on the bearing foot. Similar to bearing feet 444 described above, each bearing foot may have any suitable shape.

In some embodiments, the bearing feet 444 of the second pair of legs 436 may generally be smaller than and configured for a smaller bearing pressure than the first pair of legs 402. However, in other embodiments, the second pair of legs 436 may be similarly sized and configured as the first pair of legs 402. Moreover, in other embodiments, a drill floor structure of the present disclosure may additionally have a third or fourth pair of legs, or any suitable number of legs, each of which may employ any, or any combination of, the above-described mechanisms.

Turning now to FIGS. 5A-5D, another drill floor support structure 500 of the present disclosure is shown. As shown, the drill floor support structure 500 may be coupled to, or arranged on, a modular cellar 550, which may be similar to the modular cellar 150 described above with respect to FIGS. 1A-1C. However, in other embodiments, the drill floor support structure 500 may be coupled to, or arranged on, a drill floor or another structure or substructure of a drilling rig. The drill floor support structure 500 may have a pair of extendable legs 502. Each leg 502 may have an extension portion and a column portion. Each of the extension portion and column portions may be configured to be operably arranged in a roading position and in one or more operating positions. The extension portion may include an extension member 504 and an outer sleeve 506. The column portion may include a column member 508 extending from an end of the extension member 504 toward a ground or pad surface. The column portion may additionally include a collar 518 for adjusting an operating length of the column member 508. A bearing foot 510 may be arranged at an end of each column member 508.

The extension member 504 and outer sleeve 506 may be similar to some of those discussed above, such as with respect to FIGS. 1A-1C. In particular, the extension member 504 may be configured to operably extend or telescope from, and retract into, the corresponding outer sleeve 506. The extension members 504 and outer sleeves 506 may be sized and shaped similar to those discussed above. Additionally, however, in some embodiments each extension member 504 may have a joint 548 arranged at a location along the length of the extension member. The joint 548 may allow a portion of the extension member 504 to pivot about a generally vertical axis. In some embodiments, the extension member 504 may have two portions coupled together at the joint 548. A first portion may extend from the outer sleeve 506, and a second portion of the extension member 504 may couple to the column portion. The second portion may pivot about its connection to the first portion at the joint 548. In some embodiments, the joint 548 may include a pin or bolt arranged through aligned ears or flanges extending from the first and second portions of the extension member 504. The joint 548 may allow the pivotable portion of the extension member 504 to pivot up to 360 degrees, up to 270 degrees, up to 180 degrees, up to 90 degrees, or up to any other suitable degree of rotation. The joints 548 may generally allow for arranging the legs 502 in a variety of operating positions within the pivotable range of the jointed connection. It is to be appreciated that the legs 502 may be arranged in different orientations in some embodiments, such as with a pivotable portion of one extension member 504 pivoted in a first direction or to a first position, and with a pivotable portion of a second extension member pivoted in a second direction or to a second position. As shown for example in FIG. 5B, the joints 548 may allow the legs 502 to be pivoted to different positions as needed or desired to accommodate different spacing restraints or geometries surrounding well heads.

The column portions of the legs may be similar to some of those discussed above. For example, each column portion may extend between the corresponding extension portion and bearing foot 510 and may be configured to transfer loading to the bearing foot. Each column member 508 may be configured to scope through a collar 518 so as to extend or retract the column member. The column members 508 and collars 518 may be similar to those discussed above. Additionally, as described above with respect to FIGS. 2A-2C, each collar 518 may be pivotably or rotatably coupled to the corresponding extension portion.

The bearing feet 510 may be similar to some of those discussed above. In some embodiments, each bearing foot 510 may couple to a column member 508 with a load cell pin or other load monitoring device so as to monitor loading on the bearing foot. Each bearing foot 510 may have any suitable shape.

Figure 6A:
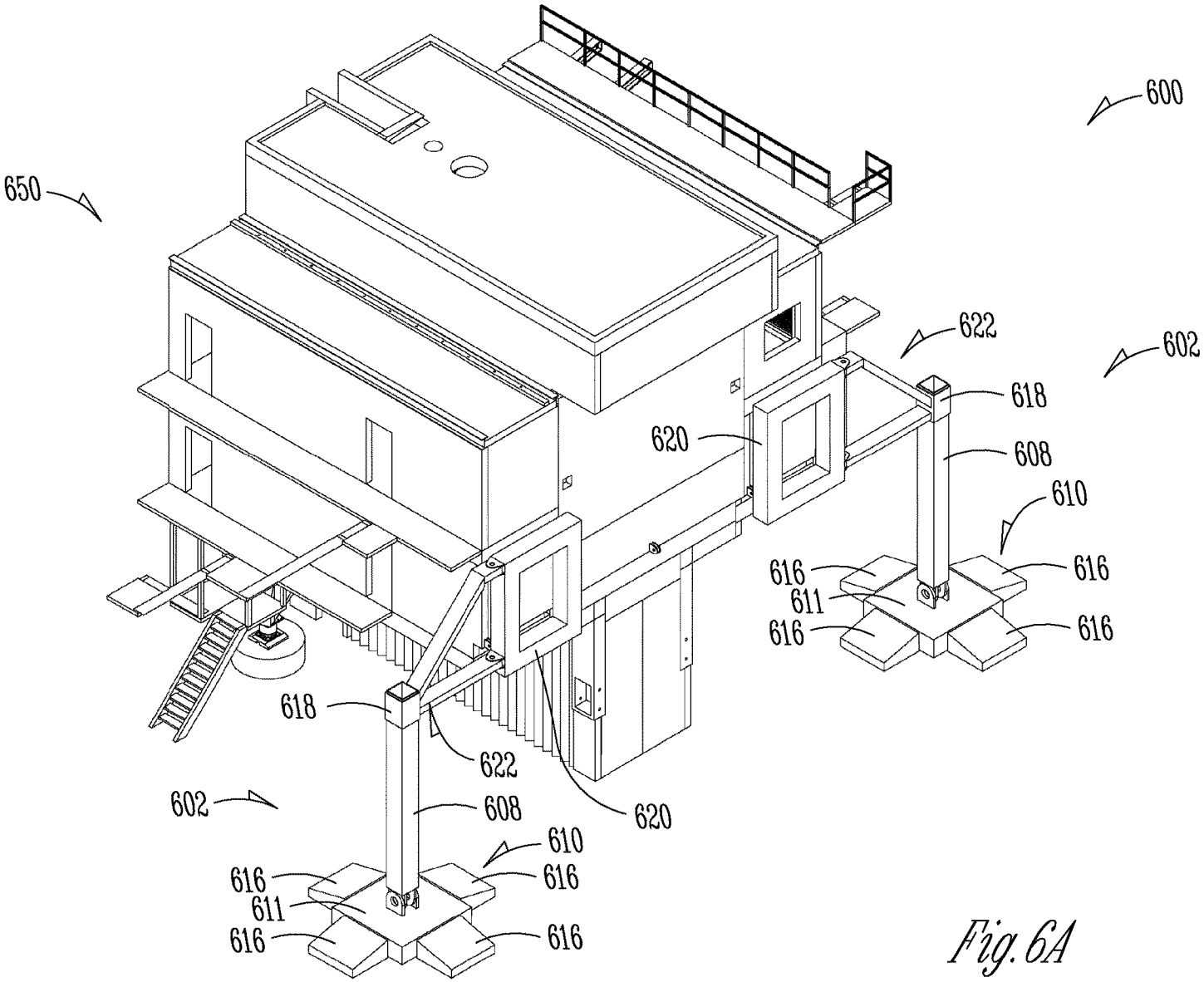
FIG. 6A is a perspective view of a drill floor support structure and modular cellar of the present disclosure, with extension portions and column portions extended, according to one or more embodiments.
Figure 6B:
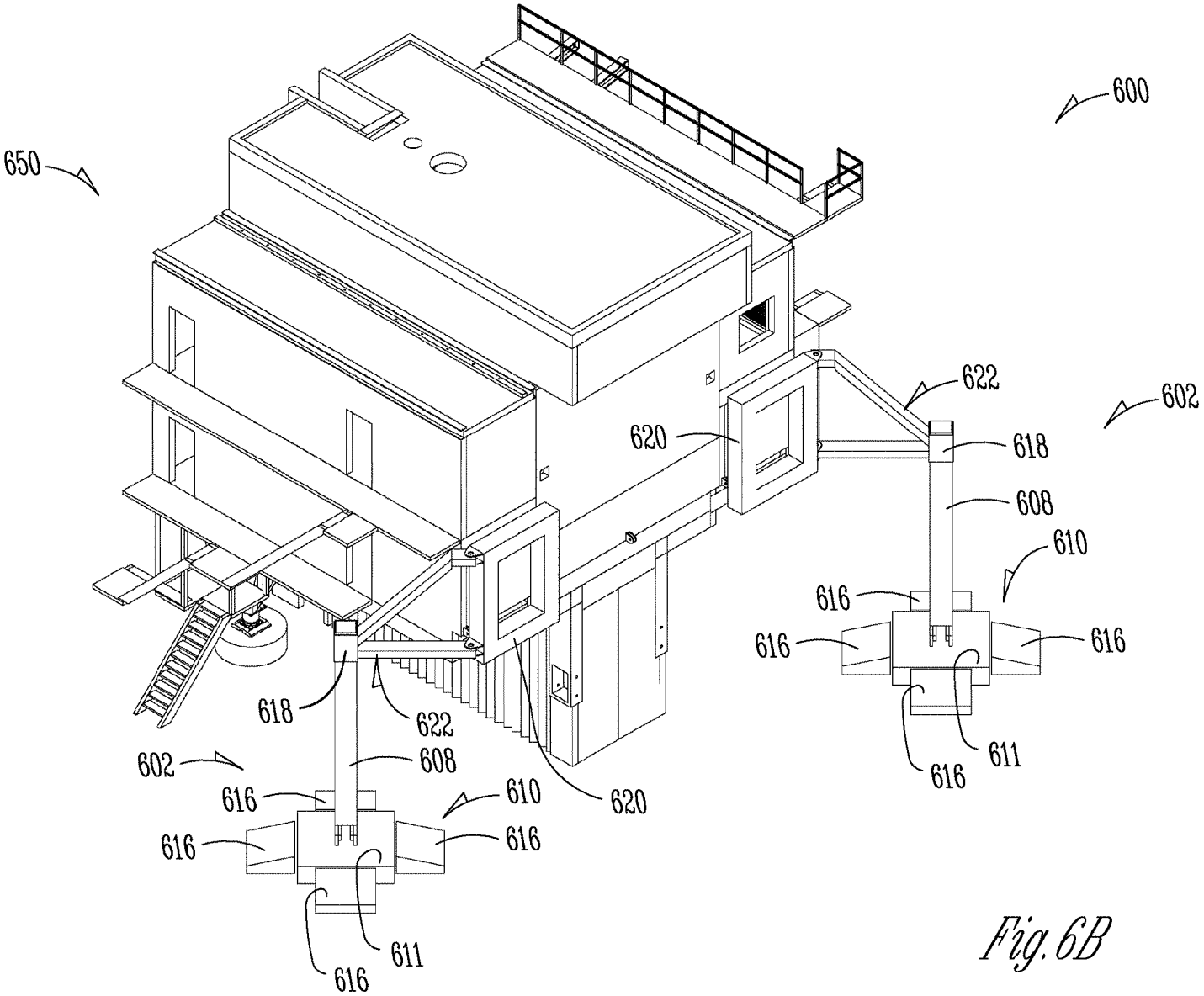
FIG. 6B is another perspective view of the drill floor support structure and modular cellar of FIG. 6A, with the extension portions pivoted to another position, according to one or more embodiments.
Figure 6C:
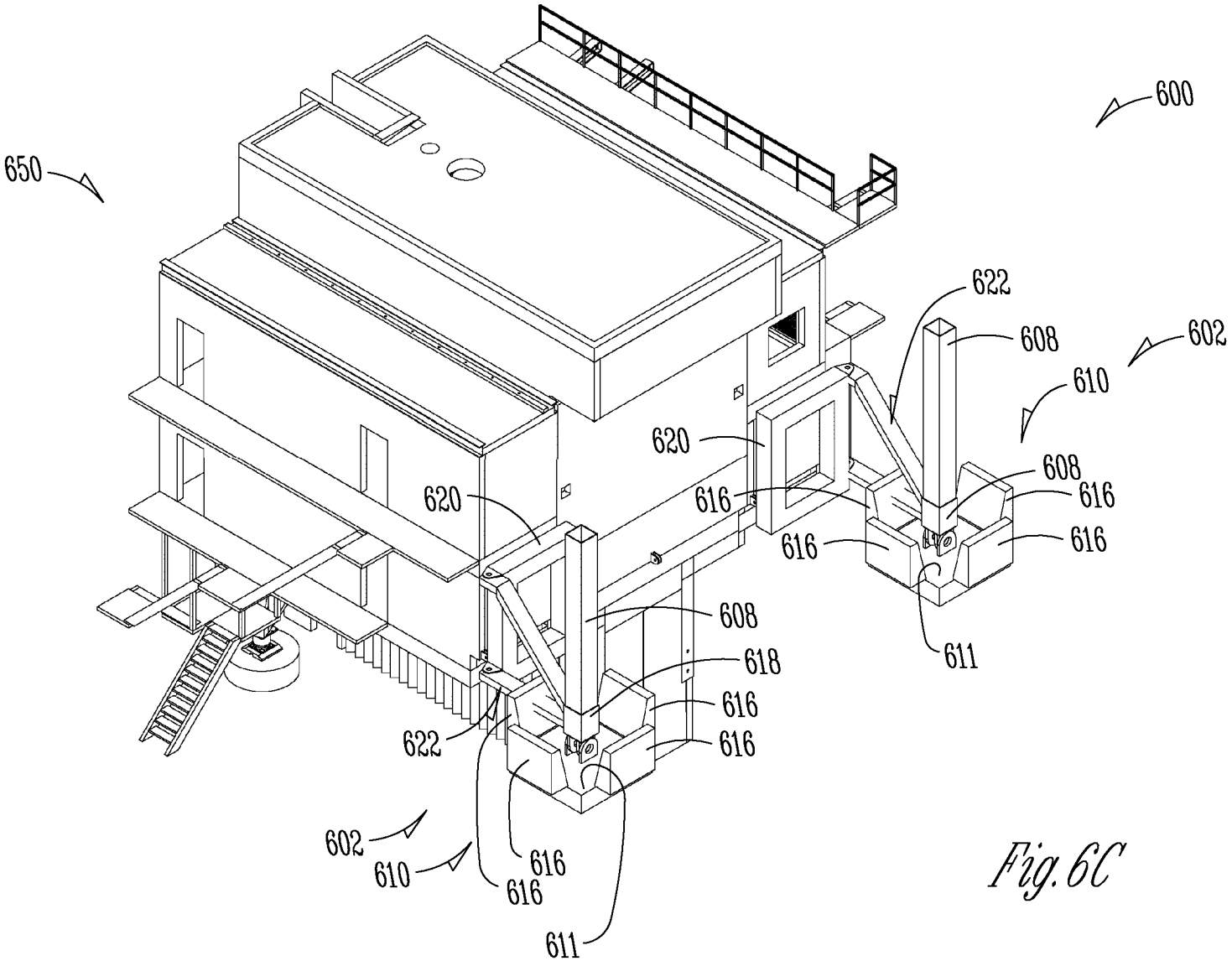
FIG. 6C is another perspective view of the drill floor support structure and modular cellar of FIG. 6A, with the column portions retracted, according to one or more embodiments.

Turning now to FIGS. 6A-6C, another drill floor support structure 600 of the present disclosure is shown. As shown, the drill floor support structure 600 may be coupled to, or arranged on, a modular cellar 650, which may be similar to the modular cellar 150 discussed above with respect to FIGS. 1A-1C. However, in other embodiments, the drill floor support structure 600 may be coupled to, or arranged on, a drill floor or another structure or substructure of a drilling rig. The drill floor support structure 600 may have a pair of extendable legs 602. Each leg 602 may have an extension portion and a column portion. Each of the extension portion and column portion may be configured to be operably arranged in a roading position and in one or more operating positions. The extension portion may include a pivoting frame 622 coupled to a support frame 620. The column portion may include a column member 608 extending from an end of the pivoting frame 622 toward a ground or pad surface. The column portion may additionally include a collar 618 for adjusting an operating length of the column member 608. A bearing foot 610 may be arranged at an end of each column member 608.

The extension portions may be similar to some of those described above with respect to other embodiments. For example, the support frames 620 may each include one or a plurality of members and may be configured to provide a point from which a pivoting frame 622 may pivot laterally. Each support frame 620 may be configured to be pinned, bolted, or otherwise coupled to a wall of a subassembly of the cellar 650, to a wall of the mezzanine, an existing drilling structure, or to any other suitable surface or location. The pivoting frame 622 of each leg 602 may couple to the support frame 620 via one or more hinged connections and may be configured to pivot the leg about a generally vertical axis. The pivoting frame 622 may have one or more, and in some embodiments two, members pivotably coupled to the support frame 620, as described above with respect to FIGS. 3A-3C, for example. Additionally, for each leg 602, one or more members of the pivoting frame 622 may couple to the collar 618 for the column portion. The pivoting frame 622 may generally be configured to pivot in an arc about a generally vertical axis to arrange the legs 602 in a variety of operating positions. The pivoting frame 622 may be configured to pivot up to 45 degrees, 90 degrees, up to 120 degrees, up to 180 degrees, or up to any other suitable degree of rotation. The pivoting frames 622 may generally allow for arranging the legs 602 in a variety of operating positions within the pivotable range of the jointed connection. It is to be appreciated that the legs 602 may be arranged in different orientations in some embodiments, such as with a pivoting frame 622 of a first leg pivoted in a first direction or to a first position and a pivoting frame of a second leg pivoted in a second direction or to a second position. As shown for example in FIG. 6B, the pivoting frames 622 may allow the legs 602 to be pivoted to different positions as needed or desired to accommodate different spacing restraints or geometries surrounding well heads.

Additionally, the column portions may be similar to some of those described above. For example, each column portion may extend between the corresponding extension portion and bearing foot 610 and may be configured to transfer loading to the bearing foot. Each column member 608 may be configured to scope through a collar 618 so as to extend or retract the column member. The column members 608 and collars 618 may be similar to those discussed above.

Each bearing foot 610 may be pivotably coupled to its corresponding column portion. The bearing foot 610 may be coupled to an end of the column member 608, opposing an end where the column member couples to the extension portion. In some embodiments, each bearing foot 610 may couple to a column member 608 with a load cell pin or other load monitoring device so as to monitor loading on the bearing foot. Each bearing foot 610 may have any suitable shape. Additionally, in some embodiments, each bearing foot 610 may have one or more removable or pivotable portions 616. For example, in at least one embodiment, each bearing foot 610 may have a square-shaped central portion 611 and four removable or pivotable portions 616, with one removable or pivotable portion arranged on each side of the square-shaped central portion. The removable or extendable portion 616 may be used to alter the footprint of the bearing feet 610 as needed or desired to accommodate different spacing constraints or geometries around well heads. As shown in FIGS. 6A and 6B, when the pivotable or removable portions 616 are attached or extended so as to be arranged on a ground or pad surface, the bearing foot 610 may have a generally cross or x-shaped footprint. One, two, three, or all of the portions 616 may be pivoted upward off of the ground or pad surface or may be removable in some embodiments. The pivotable or removable portions 616 may be pivoted or removed to change the shape of the foot 610 or to generally make the foot more compact to prepare for roading. As shown in FIG. 6C, all four portions 616 may be pivoted upward approximately 90 degrees in some embodiments. In other embodiments, the bearing feet 610 may have other suitable shapes and/or configurations.

Figure 7:
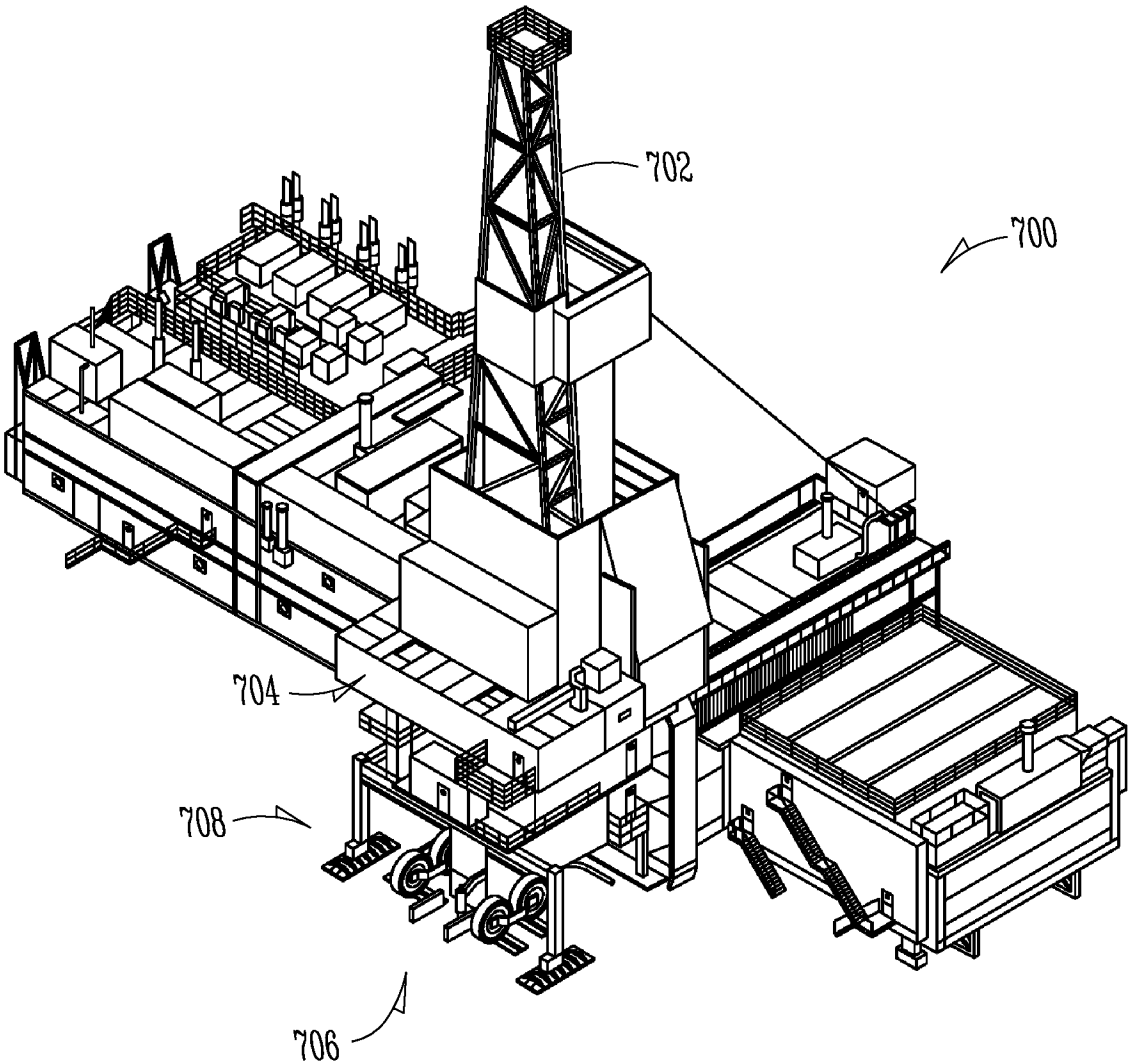
FIG. 7 is a perspective view of a drilling rig, a drill floor support structure, and a modular cellar of the present disclosure, according to one or more embodiments.

Turning now to FIG. 7, a drilling rig 700 is shown with a mast 702 extending from a drill floor 704. The rig 700 may be positioned over a well for drilling operations, for example. In some embodiments, the drill floor 704 may be a cantilevered drill floor. A modular cellar 706 may be positioned beneath, or a least partially beneath, the drill floor 704. The cellar 706 may be configured to house drilling equipment and may be similar to cellars 150, 250, 350, 450, 550, and/or 650 discussed above. In some embodiments, an upper surface of the cellar 706 may abut a lower surface of the drill floor 704. Additionally or alternatively, the cellar 706 may be coupled to the drill floor 704. As additionally shown in FIG. 7, a drill floor support structure 708 may be arranged beneath the drill floor 704 to provide stiffening support for the drill floor. The drill floor support structure 708 may be configured to transfer loading, including a dead load, hook load, wind load, and/or other loading, from the drilling floor to a ground surface or pad surface. The support structure 708 may couple to, or extend from, the modular cellar 706 in some embodiments. However, in other embodiments and as described above, the drill floor support structure 708 may couple to, or extend from, the drill floor 704 or another structure or sub-structure. The drill floor support structure 708 may have a pair of extendable legs extending toward a ground or pad surface. A bearing foot may be arranged at an end of each extendable leg. The support structure 708 may be, or may be similar to, any of the support structures 100, 200, 300, 400, 500, and/or 600 discussed above.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

Additionally, as used herein, the phrase "at least one of [X] and [Y]," where X and Y are different components that may be included in an embodiment of the present disclosure, means that the embodiment could include component X without component Y, the embodiment could include component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A modular drilling cellar configured to be arranged beneath a drill floor of a drilling rig, the modular drilling cellar comprising:

a housing for storing well head equipment; and a drill floor support structure comprising a pair of support legs, each leg comprising:

an extension portion coupled to the cellar and configured to be arranged in an operating position and a roading position;

a column portion coupled to the extension portion and configured to be arranged in an operational position and a roading position; and a bearing foot coupled to the column portion.

2. The modular drilling cellar of claim 1, wherein the extension portion comprises an extension member extendable from an outer sheath.

3. The modular drilling cellar of claim 1, wherein the extension portion comprises a pivoting frame.

4. The modular drilling cellar of claim 1, wherein the extension portion comprises a retractable frame.

5. The modular drilling cellar of claim 1, wherein the column portion comprises two members coupled together at a hinged connection.

6. The modular drilling cellar of claim 1, wherein the column portion comprises a column member configured to scope through a collar coupled to the extension portion.

7. The modular drilling cellar of claim 1, wherein the bearing foot is configurable and comprises at least one removable section.

8. The modular drilling cellar of claim 1, wherein the bearing foot comprises at least one hinged section.

9. The modular drilling cellar of claim 1, wherein the bearing foot is coupled to the column portion using a load cell pin.

10. The modular drilling cellar of claim 1, wherein each leg is independently actuable.

11. The modular drilling cellar of claim 1, further comprising a second pair of legs.

12. A drill floor support structure comprising a pair of support legs, each leg configured to be arranged in a roading position and an operating position, each leg comprising:

an extension portion coupled to the drill floor support structure and configured to be arranged in an operating position and a roading position;

a column portion directly coupled to the extension portion and configured to be arranged in an operational position and a roading position; and a bearing foot coupled to the column portion.

13. The drill floor support structure of claim 12, wherein the extension portion comprises at least one of:

an extension member extendable from an outer sheath;

a pivoting frame; and a retractable frame.

14. The drill floor support structure of claim 12, wherein the column portion comprises two members coupled together at a hinged connection.

15. The drill floor support structure of claim 12, wherein the column portion comprises a column member configured to scope through a collar coupled to the extension portion.

16. The drill floor support structure of claim 12, wherein the bearing foot is configurable and comprises at least one removable section.

17. The drill floor support structure of claim 12, wherein the bearing foot comprises at least one hinged section.

18. The drill floor support structure of claim 12, wherein each leg is independently actuable.

19. A drilling rig comprising:

a drill floor; and a drill floor support structure configured to transfer loading on the drill floor to a ground or pad surface, the drill floor support structure comprising a pair of support legs, each leg configured to be arranged in a roading position and an operating position, each leg comprising:

an extension portion coupled to the drill floor support structure and configured to be arranged in an operating position and a roading position;

a column portion directly coupled to the extension portion and configured to be arranged in an operational position and a roading position; and a bearing foot coupled to the column portion.

20. The drill floor support structure of claim 19, wherein the extension portion comprises at least one of:

an extension member extendable from an outer sheath;

a pivoting frame; and a retractable frame.

* * * * *